US006336414B1

(12) United States Patent
Stewart et al.

(10) Patent No.: US 6,336,414 B1
(45) Date of Patent: Jan. 8, 2002

(54) TABLE CONFIGURED FOR UTILITIES, GANGING AND STORAGE

(76) Inventors: Robert L. Stewart, 2122 Sante Fe Trail, Grapevine, TX (US) 76051; Michael L. Deimen, 544 Hoover Rd., Burleson, TX (US) 76028; Frank A. Friedman, 77 S. Knoll Rd., Mill Valley, CA (US) 94941; David M. Webster, 23 Montcalm, San Francisco, CA (US) 94110; Kristine R. Chan-Lizardo, 2303 Oberlin St., Palo Alto, CA (US) 94306; James R. Yurchenco, 4102 Sutherland Dr., Palo Alto, CA (US) 94303; Annetta M. Papadopoulos, 1155 Lincoln Ave., Palo Alto, CA (US) 94301; Diego A. Rodriguez, 640 68th St., Boulder, CO (US) 80303

( * ) Notice: Subject to any disclaimer, the term of this patent is extended or adjusted under 35 U.S.C. 154(b) by 0 days.

(21) Appl. No.: 09/495,707

(22) Filed: Jan. 31, 2001

(51) Int. Cl.[7] ..... A47B 3/08

(52) U.S. Cl. ..... 108/50.02; 108/6; 108/64; 108/115; 312/223.6

(58) Field of Search ..... 108/2, 6, 7, 50.02, 108/50.01, 64, 65, 91, 179, 176, 128, 115, 136, 90, 27; 248/345.1; 312/223.6; 52/468, 469, 471, 796.12, 797.1, 718.04, 718.02

(56) References Cited

U.S. PATENT DOCUMENTS

| | | | | |
|---|---|---|---|---|
| 2,836,475 A | | 5/1958 | Sapp | |
| 3,115,850 A | | 12/1963 | Sloan | |
| 3,166,029 A | | 1/1965 | Acton | |
| 3,309,100 A | | 3/1967 | Barbuti | |
| 3,442,406 A | | 5/1969 | Lowe | |
| 3,536,283 A | | 10/1970 | Lowe | |
| 3,640,228 A | | 2/1972 | Busse | |
| 3,742,869 A | | 7/1973 | Polsky et al. | |
| 3,796,169 A | | 3/1974 | Bales et al. | |
| 3,805,710 A | * | 4/1974 | Leshem | 108/6 |
| 3,827,376 A | | 8/1974 | Solomon | |
| 4,158,335 A | | 6/1979 | Belcastro et al. | |
| 4,372,631 A | | 2/1983 | Leon | |
| 4,748,913 A | | 6/1988 | Favaretto et al. | |

(List continued on next page.)

FOREIGN PATENT DOCUMENTS

| | | | | |
|---|---|---|---|---|
| CA | 754962 | * | 3/1967 | 108/115 |
| GB | 2100121 | * | 12/1982 | 108/64 |

*Primary Examiner*—Peter M. Cuomo
*Assistant Examiner*—Michael J. Fisher

(57) ABSTRACT

A table construction includes a base having a pair of legs secured together by a transverse beam, and a tabletop pivoted to a top of the legs for movement between a horizontal use position and a vertical storage position. A pair of support arms are pivoted to the top of the legs for selectively holding the tabletop in the horizontal use position. The support arms are spring-biased and pivoted at an angle so that they counterbalance a weight of the tabletop during its pivotal movement. Ganging connectors on opposite ends of the tabletop automatically interconnect adjacent tables upon pushing adjacent tables together. The legs each include first and second castings that bolt together and that are arranged to matably nest when tables are moved together for storage. A utility raceway structure attached to the base includes a frame that defines upper and lower chambers and further includes upper and lower lockable doors providing separate access to the upper and lower chambers, respectively. A utility outlet is releasably attached to the frame, and includes a face accessible in the first chamber and includes a utility supply connector accessible from below the upper transverse beam. A utility supply conduit is positioned in the second chamber and operably connected to the utility supply connector.

38 Claims, 16 Drawing Sheets

U.S. PATENT DOCUMENTS 4,810,550 A * 3/1989 Gasser
4,879,954 A * 11/1989 Sawamura et al. ..... 108/6
4,915,034 A * 4/1990 Grabe et al. ..... 108/65
4,955,294 A * 9/1990 Abe ..... 108/6
4,986,195 A 1/1991 Diffrient
5,078,055 A * 1/1992 Bellini et al. ..... 108/64
D325,833 S 5/1992 Saotome
D330,299 S 10/1992 Saotome
5,205,223 A 4/1993 Ball et al.
D336,393 S 6/1993 Saotome
5,337,657 A 8/1994 Diffrient
D352,845 S 11/1994 Hellwig et al.
D366,791 S 2/1996 Grosfillex
5,606,920 A 3/1997 Meyer et al.
5,622,119 A 4/1997 Hsieh
5,640,912 A 6/1997 Diffrient
5,678,948 A 10/1997 White
5,746,660 A 5/1998 Grover
5,794,545 A 8/1998 McDaniel et al.
D399,685 S 10/1998 Grosfillex
5,878,673 A 3/1999 Kramer et al.
5,906,420 A 5/1999 Rozier, Jr. et al.
5,927,214 A 7/1999 Schwartz et al.
5,934,201 A 8/1999 Diffrient
5,934,203 A 8/1999 Glass
5,947,628 A 9/1999 Hansen
5,971,509 A * 10/1999 Deimen et al. ..... 312/223.6

* cited by examiner

TABLE CONFIGURED FOR UTILITIES, GANGING AND STORAGE

BACKGROUND OF THE INVENTION

The present invention relates to work tables configured to support utilities, configured to gang together during use, and configured to permit dense storage.

Tables are commonly used in work, home, community, and educational environments to provide flat worksurfaces that can be flexibly used to support group activities. It is known to provide portable tables that can be arranged and rearranged for changing needs, and it is known to provide electrified tables that support electronic equipment, such as computers, communication equipment, and/or food heaters. However, improvements are desired to make tables even more adapted for flexible and ergonomic use and to facilitate their rearrangeability and reconfigurability, while maintaining a clean appearance. For example, it is important that utilities be supported and also that utilities be easily added, deleted, changed and/or accessed. At the same time, it is preferable to provide some level of security for the utility supply and/or the utility ports and connections. Further, the tables must preferably provide a clean and uncluttered look, even when a computer with multiple power and communication lines is connected. In addition to being useful, it is desirable to construct the tables to permit dense storage when not in use, and to construct the tables for ganging in secure but easily releasable arrangements.

Accordingly, a table is desired solving the aforementioned problems and offering the aforementioned advantages.

SUMMARY OF THE PRESENT INVENTION

In one aspect of the present invention, a table construction includes a base, a tabletop pivoted to the base for movement about a first axis between a horizontal use position and an angled storage position, and at least one support arm pivoted to the base. The support arm is movable about a second axis between a tabletop-braced position where the tabletop is held in the horizontal use position and a released position where the tabletop is released for movement to the storage position. The at least one arm is biased and pivoted to slidably engage the tabletop and counterbalance a weight of the tabletop as the tabletop is pivoted between the use and storage positions.

In another aspect of the present invention, a table construction includes a base, and a tabletop pivoted to the base for movement about a first axis between a horizontal use position and an angled storage position. The base includes a pair of legs connected by a transverse beam. The pair of legs each include first and second leg members having joint sections that matingly engage and are secured together. The first leg member has a forward extension and the second leg member has a rearward extension, with the forward extension being inboard of the rearward extension so that, when the tabletop is in the storage position, the forward extension of the table construction is adapted to extend inboard of and adjacent a rearward extension of a similar table construction when nested thereagainst.

In yet another aspect of the present invention, a table construction includes first and second tables each having a base and a tabletop supported on the associated base. The first table includes a male connector at a first end and the second table includes a female connector at a second end configured to releasably engage the male connector. The female connector defines a funnel-shaped chute with angled sidewalls shaped to receive the male connector and shaped to automatically align the first and second tables in a ganged arrangement when the first and second tables are moved together.

In another aspect of the present invention, a table construction includes first and second tables each having a base with legs and a tabletop supported on the associated base. The first table includes a male connector at a first end and the second table includes a female connector at a second end configured to releasably engage the male connector. The male connector defines a nose surface shaped to matably engage the female connector to automatically align the first and second tables in a predetermined ganged arrangement as the first and second tables are moved together. The male connector is pivotally movable about a horizontal axis between a horizontal engagement position where the male connector extends from an associated one of the legs and a lowered storage position where the male connector is positioned adjacent the associated one leg.

In another aspect of the present invention, a table construction includes a base and a tabletop supported on the base. The base includes a pair of legs connected by a transverse beam. A utility module is attached to the base. The utility module defines upper and lower chambers and includes upper and lower doors providing separate access to the upper and lower chambers, respectively.

In another aspect of the present invention, a table construction includes a base, a tabletop attached to the base, and a utility module attached to the base. The utility module includes a frame with upper and lower transverse beams defining a chamber therebetween. A utility outlet is attached to the upper beam, the utility outlet including a face accessible from above the upper transverse beam that is adapted for releasable connection to a utility-using device and including a utility supply connector accessible from below the upper transverse beam. A utility supply conduit is positioned in the chamber and operably connected to the utility supply connector.

In another aspect of the present invention, a table construction includes a base, a tabletop for movement about a first axis between a horizontal use position and an angled storage position, and a utility module supported by the base. The utility module has a utility outlet that is covered and difficult to access when the tabletop is in the horizontal use position, but that is uncovered and readily accessible when the tabletop is in the angled storage position.

In another aspect of the present invention, a table construction includes first and second tables each having a base and a tabletop pivotally supported on the base for movement between a horizontal use position and an angled storage position. The first and second tables include mating ganging connectors configured to releasably engage and hold the first and second tables together in a fixed interconnected arrangement. The first and second tables when in the fixed interconnected arrangement have abutting edges. At least one of the abutting edges has a resilient edge material that compresses to tension the gaining connectors and also to prevent light leaks between the abutting edges when the tabletops are both in the horizontal use position, but further that flexes to allow the tabletops to be individually pivoted from the horizontal use position without adversely damaging and abrading either one of the abutting edges.

In another aspect of the present invention, a portable table includes a base, a tabletop pivoted to the base for movement between a use position and an angled storage position, and a ganging connector on one of the base and the tabletop. The ganging connector is adapted to engage a mating ganging connector on another table to hold the portable table in a ganged arrangement. A utility module is attached to one of the base and the tabletop and is adapted to supply utilities to utility-using devices on the tabletop.

In another aspect of the present invention, a table construction includes a base having first and second legs that are spaced apart. The first and second legs each include a top section with a top pivot mount being located at a first side of the top section and a fixed support being located at a second side of the top section opposite the first side. A tabletop includes a middle portion and front and rear portions. The tabletop is pivoted to the top pivot mounts on the first and second legs at locations in the middle portion of the tabletop so that a weight of the front portion counterbalances a weight of the rear portion as the tabletop is pivoted. The fixed support is positioned to engage and support the tabletop when the tabletop is pivoted to a horizontal use position.

These and other aspects, advantages, and objects will be further understood and appreciated by those skilled in the art upon a close reading of the present specification, claims and appended drawings.

BRIEF DESCRIPTION OF DRAWINGS

FIGS. 16–18 are orthogonal views of the molded protector attached to the legs as shown in FIG. 9, the dashed lines in FIG. 16 showing the leg casting of FIG. 13 that the protector is attached to;

DETAILED DESCRIPTION OF PREFERRED EMBODIMENT

Figure 4:
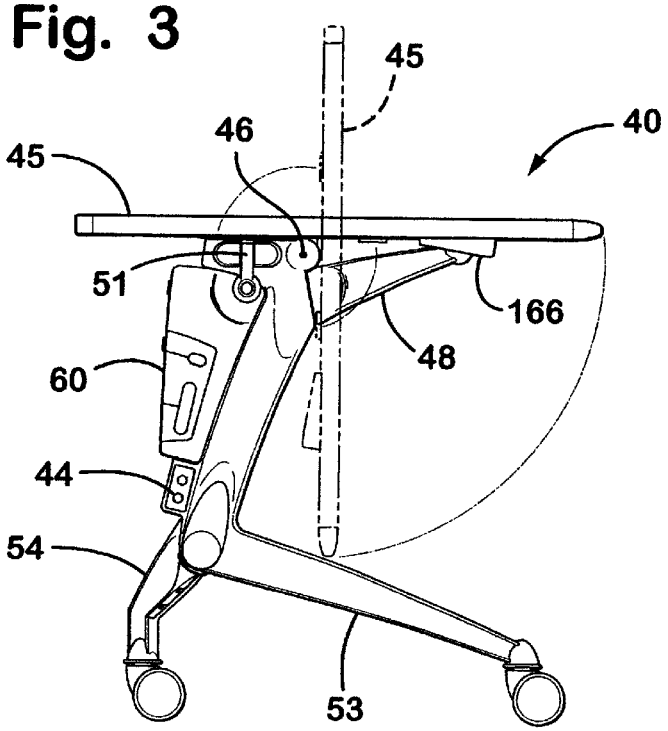
Figure 6:
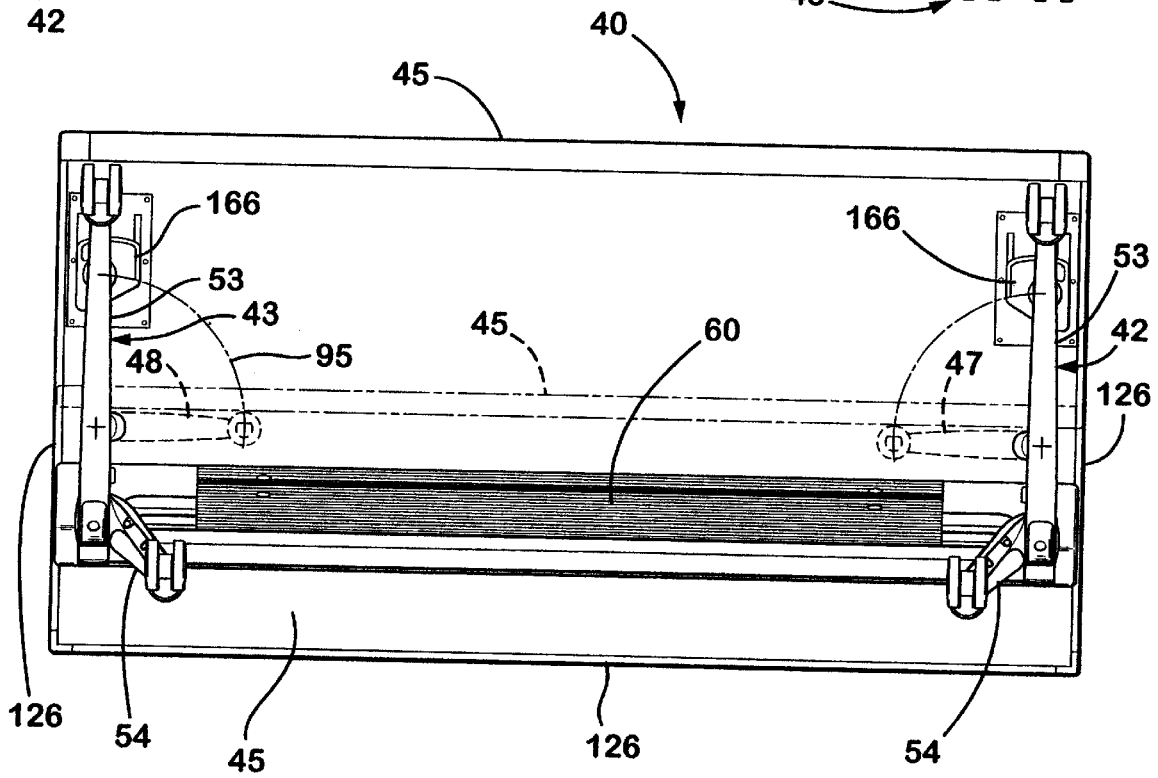
Figure 37:
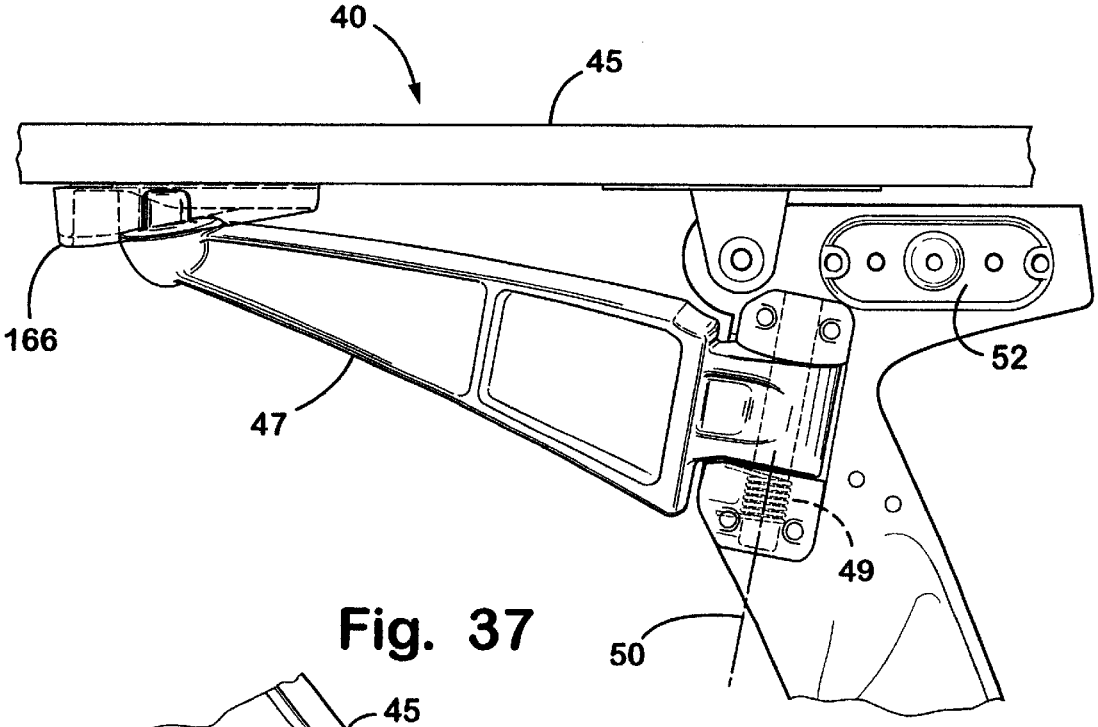
FIG. 37 is a fragmentary side view of the tabletop, arm, and latch shown in FIG. 6.

A table construction 40 (FIG. 1) is adapted for utilities, for ganging, and for nested storage. The table construction 40 includes a base 41 having a pair of legs 42 and 43 secured together by a transverse beam 44 and by a tabletop 45 pivoted to a top of the legs 42 and 43. The tabletop 45 is pivoted for movement about an axis 46 between a horizontal use position (FIGS. 4 and 6, solid lines) and a vertical storage position (FIGS. 4 and 6, dashed lines). A pair of support arms 47 and 48 (FIGS. 2 and 4) are pivoted to the top of the 42 and 43 legs for selectively holding the tabletop 45 in the horizontal use position. The support arms 47 and 48 are spring-biased by springs 49 (FIG. 37) pivoted for movement about an angled axis 50 (FIGS. 10–11) at an angle from a plumb vertical direction 50' so that they counterbalance a weight of the tabletop 45 during its pivotal movement.

Figure 5:
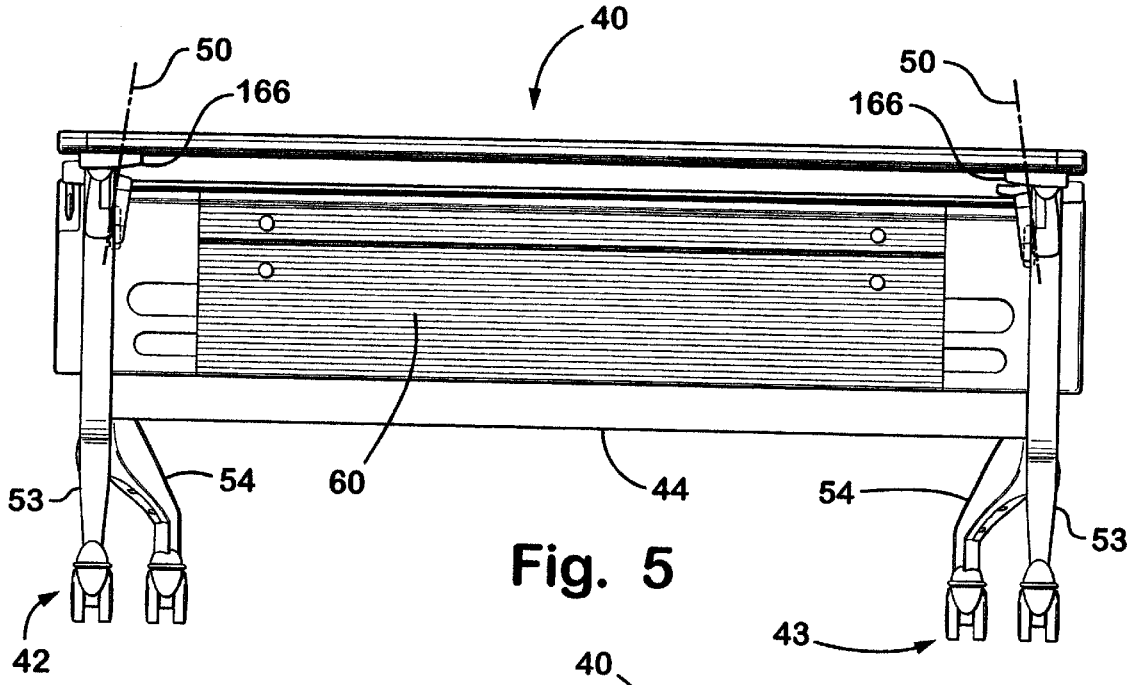
Figure 7:
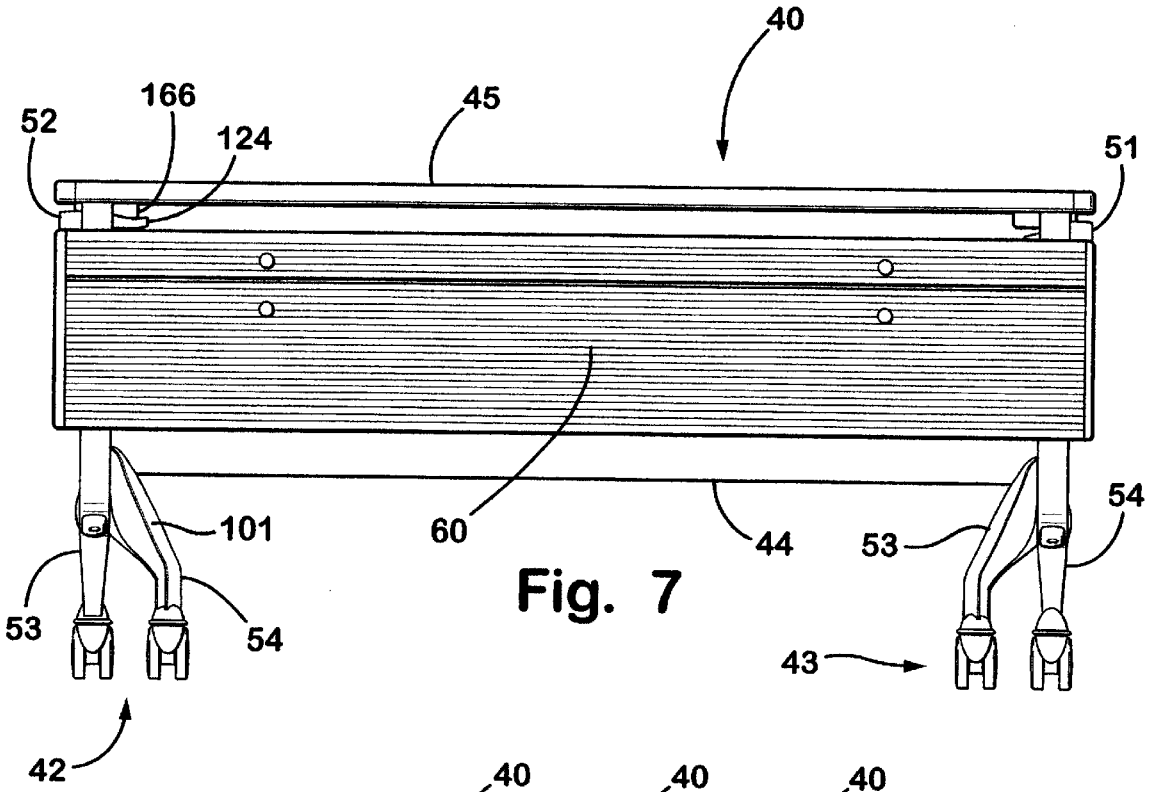
Figure 8:
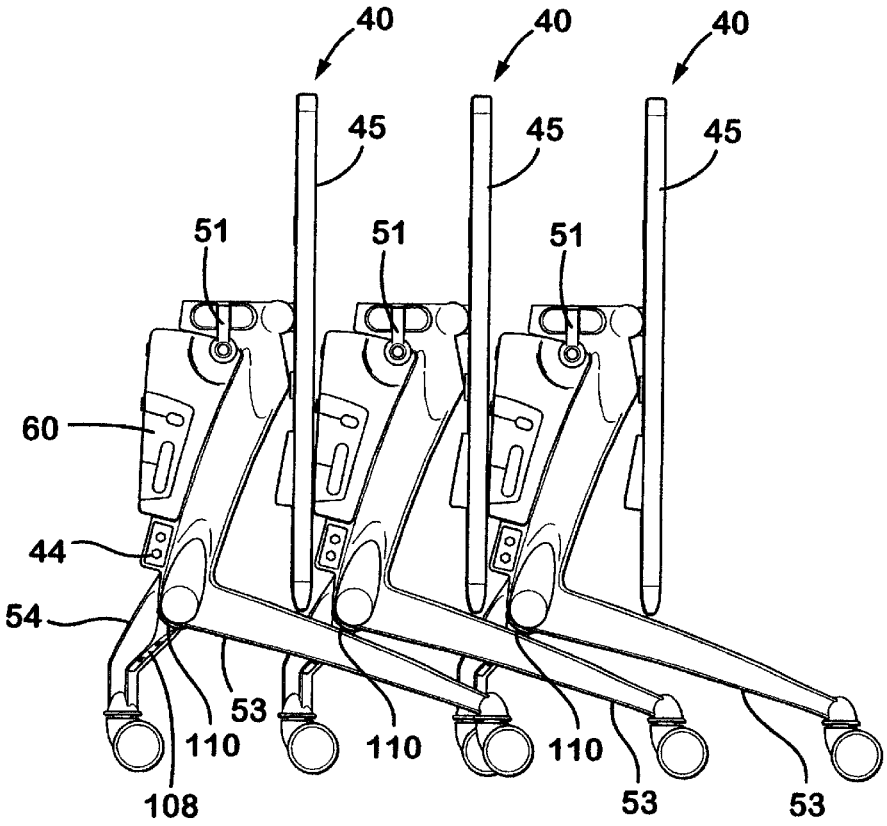
FIG. 8 is a side view showing three of the tables of FIG. 1 nested together in a dense storage arrangement, their tabletops being in the folded storage position.
Figure 9:
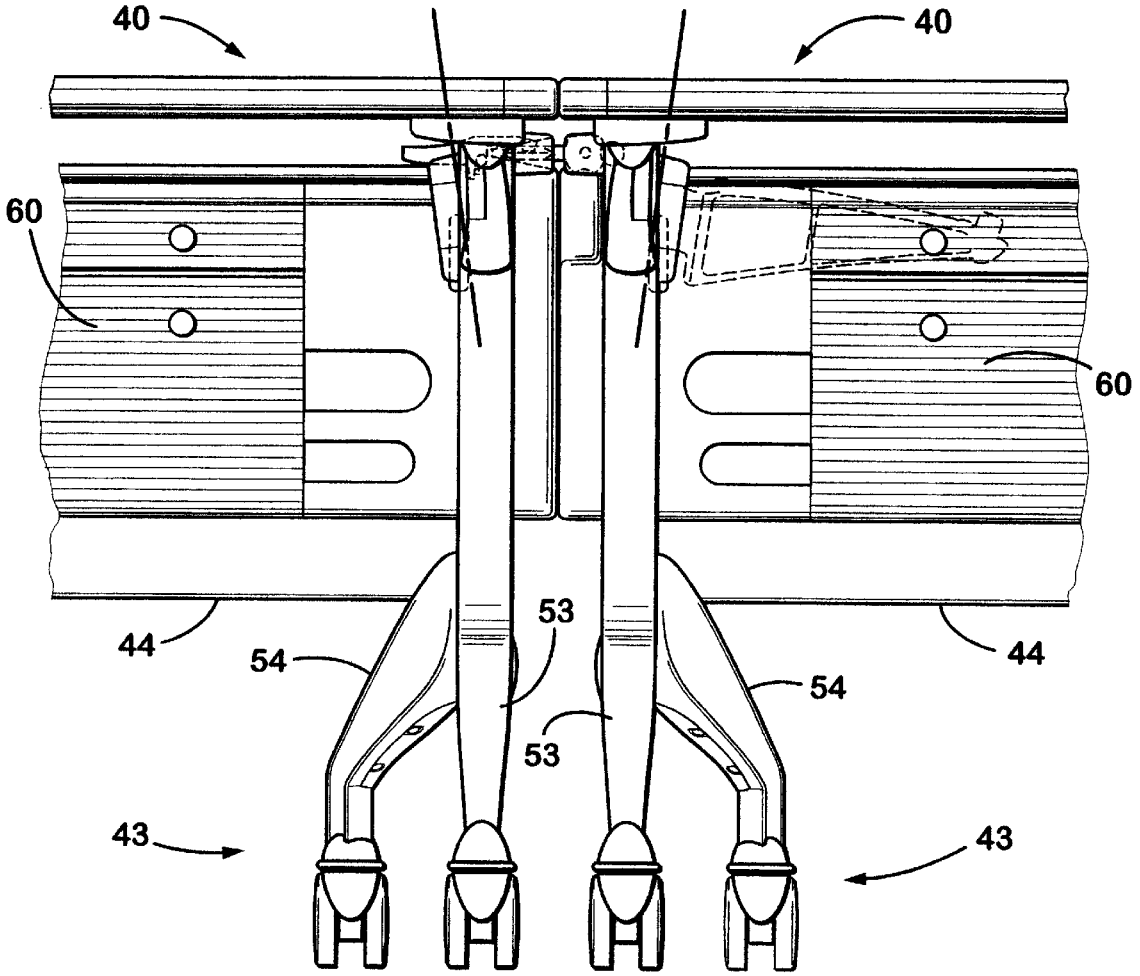
FIG. 9 is a fragmentary front view of two tables ganged together, the dashed lines showing a support arm in a storage position.
Figure 9A:
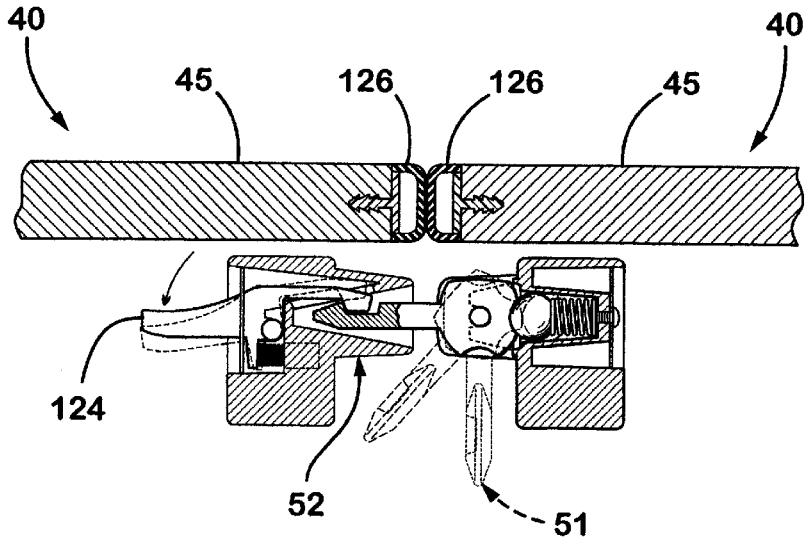
FIG. 9A is a fragmentary vertical cross section taken through the ganged joint shown in FIG. 9.
Figure 21:
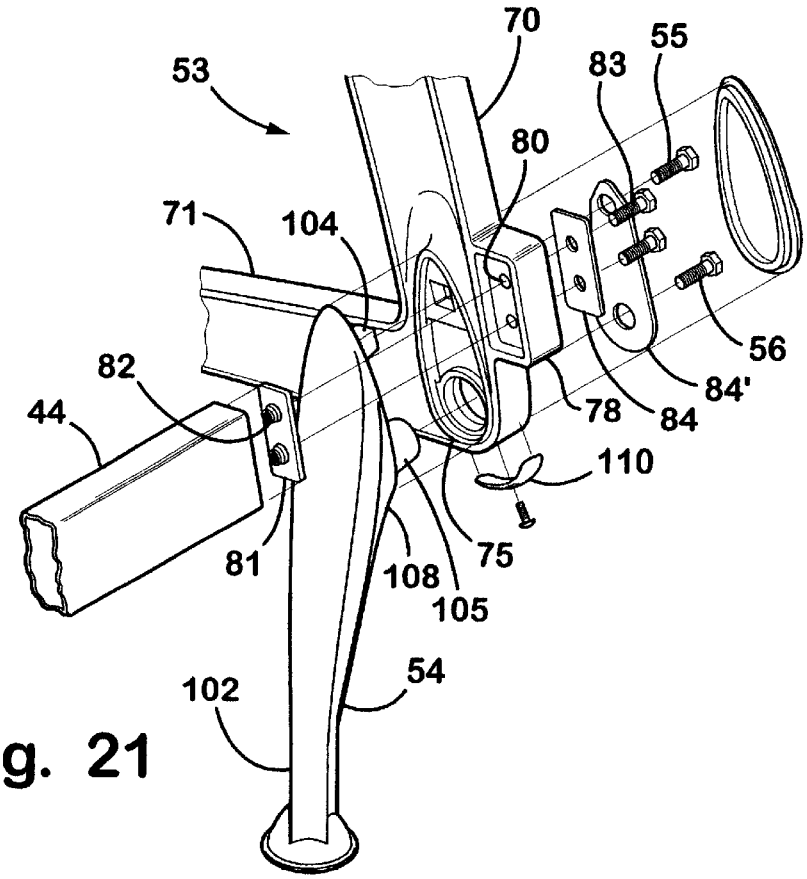
FIG. 21 is an exploded perspective view of the joints shown in FIG. 20.

The legs 42 and 43 (FIGS. 4–6) are substantially mirror images of each other and each include first and second castings 53 and 54 that are attached together by bolts 55 and 56 (FIG. 21). The castings 53 and 54 include laterally extending feet that are arranged in inboard and outboard positions to mateably nest when tables 40 are moved together for storage (FIGS. 7–8). The legs 42 and 43 are configured to nest into the legs of an adjacent similar table 40, such that the table constructions 40 are storable in a dense nested arrangement that saves at least about 50% of occupied space.

Figure 1:
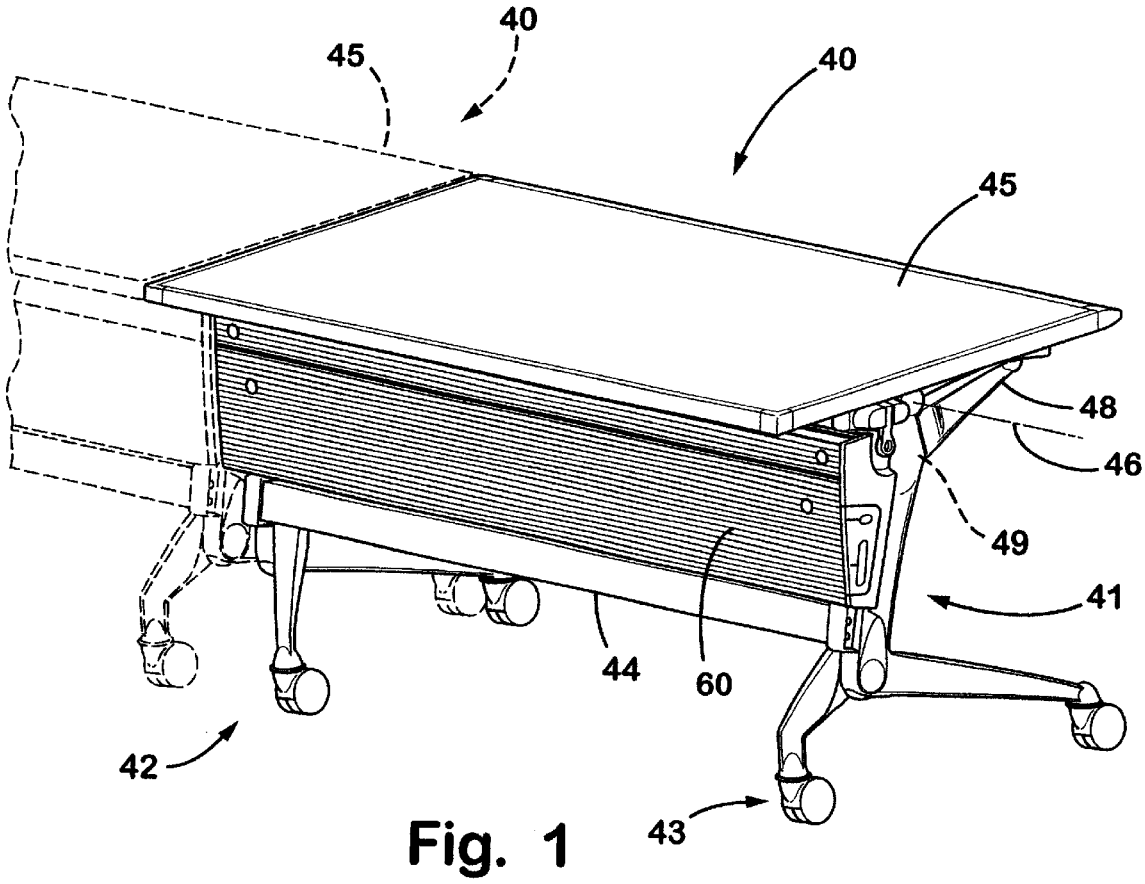
FIG. 1 is a perspective view of a table embodying the present invention, including a second table shown in dashed lines connected to the first table in a ganged arrangement.
Figures 22, 23, 24, 25:
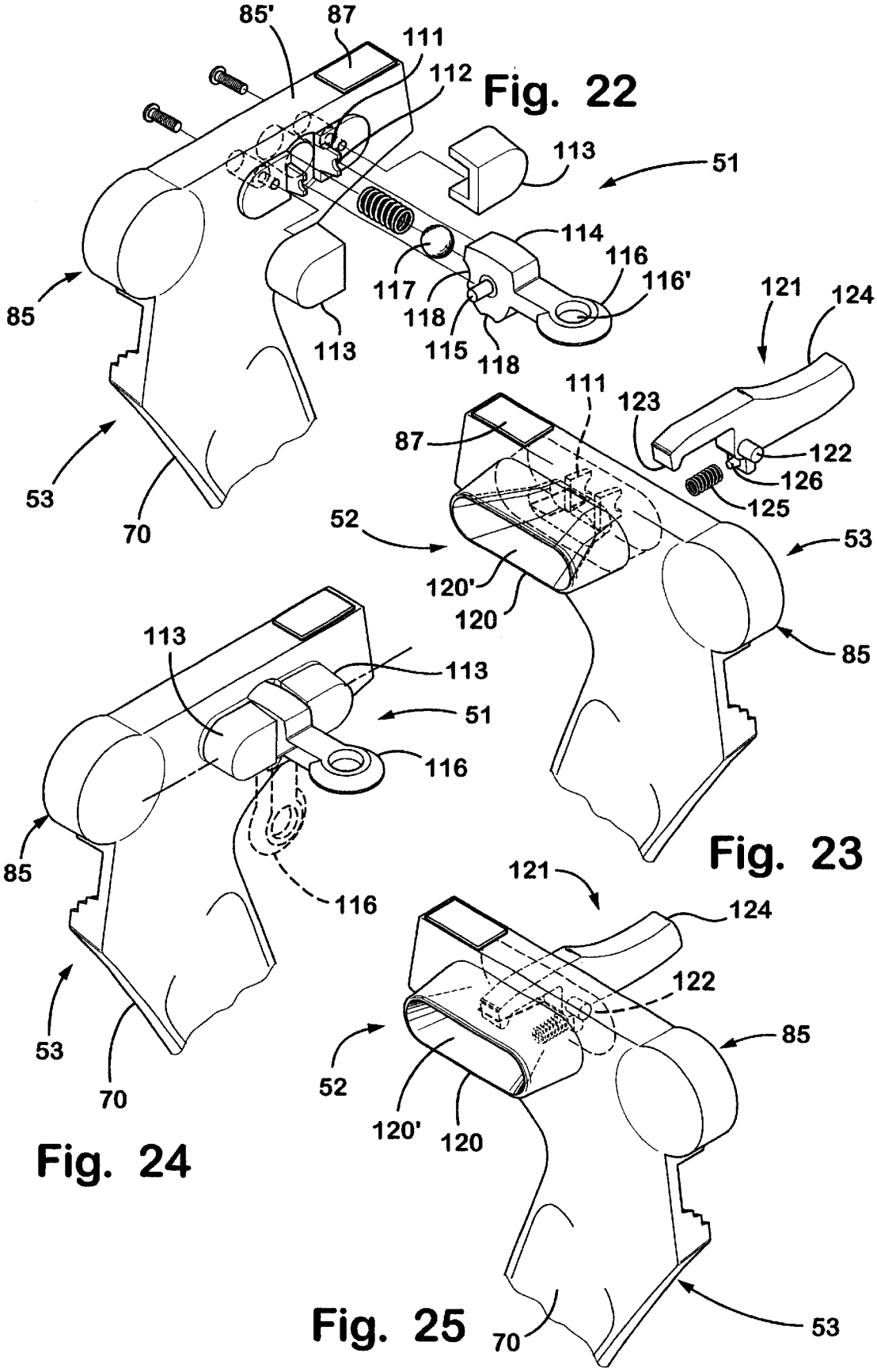
FIG. 22 is an exploded fragmentary perspective view of the male ganging connector shown in FIGS. 4 and 9A.
FIG. 23 is an exploded fragmentary perspective view of the female ganging connector shown in FIGS. 2 and 9A.
FIGS. 24 and 25 are fragmentary perspective assembly views of the male and female ganging connectors, respectively, shown in FIGS. 22 and 23 respectively.
Figure 40:
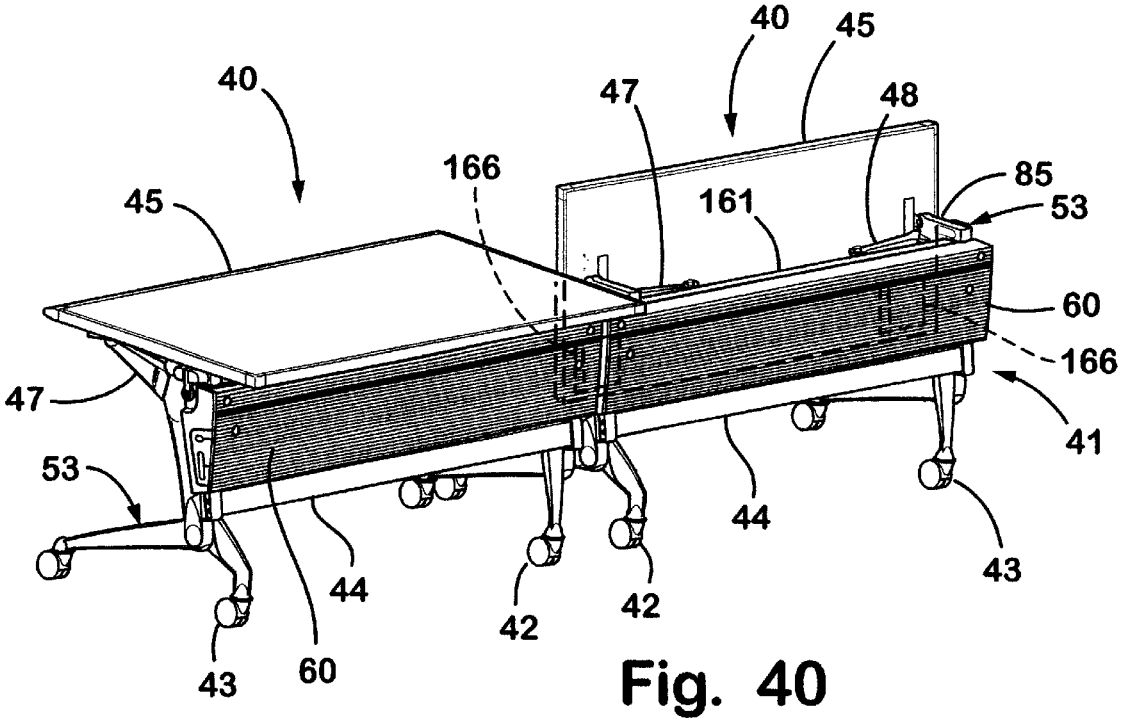
FIG. 40 is a perspective view of two tables ganged together similar to that shown in FIG. 1, but with one tabletop in a horizontal use position and one tabletop pivoted to a vertical storage position.

The table 40 includes mating ganging connectors 51 and 52 (FIGS. 24–25) attached to legs 42 and 43 on opposite ends of the tabletop 45. The ganging connectors 51 and 52 are configured to automatically align and interconnect adjacent tables 40 upon pushing the adjacent tables together (FIGS. 1 and 40).

Figure 41:
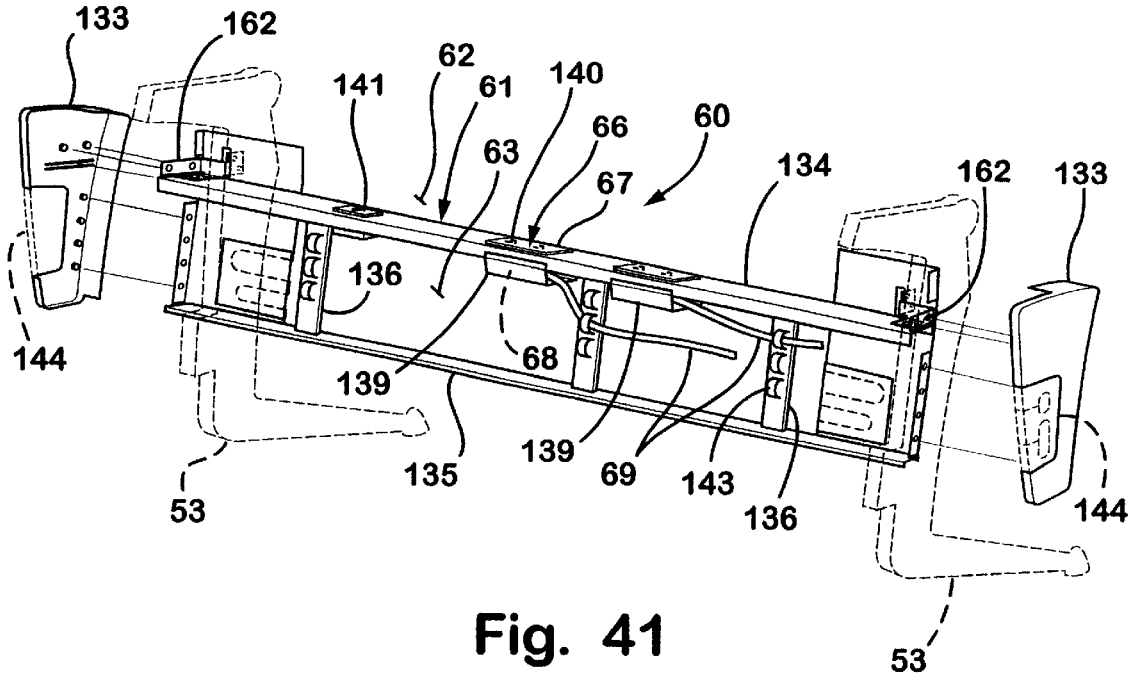
FIG. 41 is a perspective view of the utility module shown in FIG. 1, including its frame but with the doors removed to more clearly reveal the frame.
Figure 42:
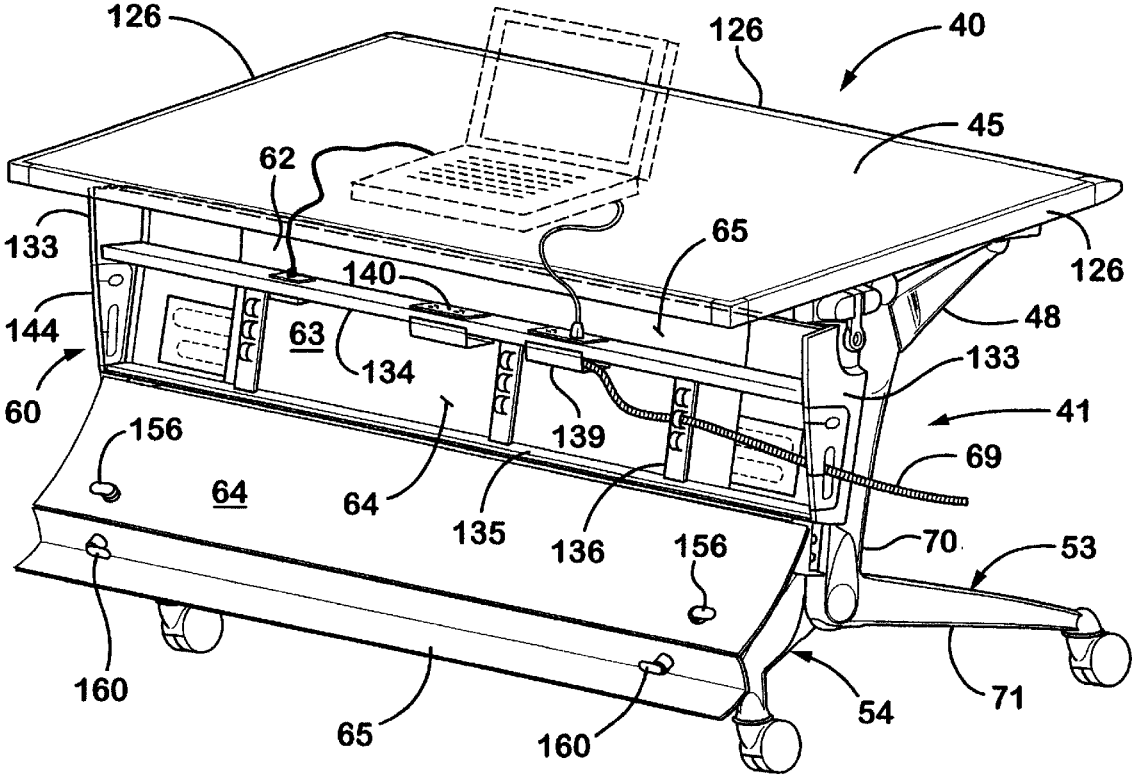
FIG. 42 is a fragmentary top perspective view of the utility module shown attached to a table as shown in FIG. 1, the doors for covering the frame of the utility module being opened to expose utility wiring housed therein.
Figure 43:
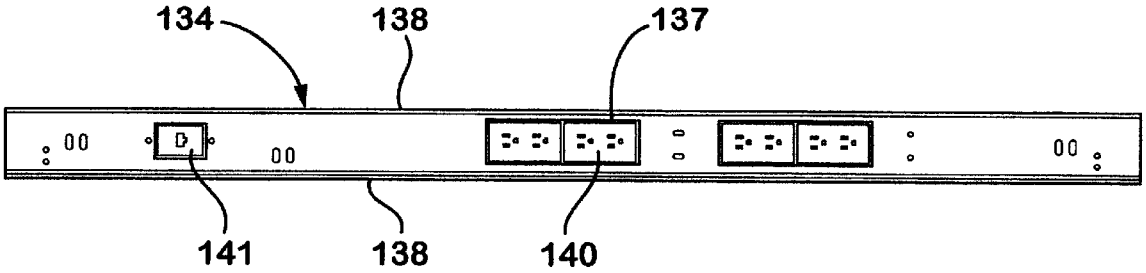
FIG. 43 is a plan view of a top of the extruded top beam of the frame shown in FIG. 41.

A utility module 60 (FIGS. 41 and 42) (sometimes also referred to herein as a "utility raceway structure") is attached to the base 41 and includes a frame 61 that defines upper and lower chambers 62 and 63 and further includes front and rear lower doors 64 and front and rear upper doors 65 providing separate access to the upper and lower chambers 62 and 63, respectively. Notably, it is contemplated that one or both of the doors can be locked to provide limited access to one or both of the chambers 62 and 63. A utility outlet 66 is releasably attached to the frame 61, and includes a face 67 accessible from above in the upper chamber 62 and includes a utility supply connector 68 (such as electrical terminals) accessible from only the lower chamber 63. Utility supply conduit 69 is positioned in the lower chamber 63 and is operably connected to the utility supply connector 68.

Figure 11:
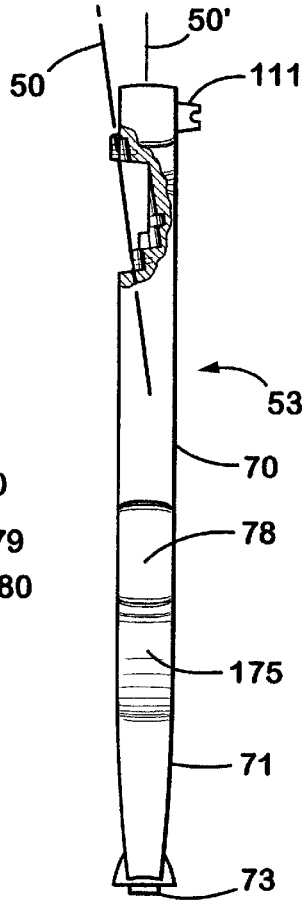
Figure 12:
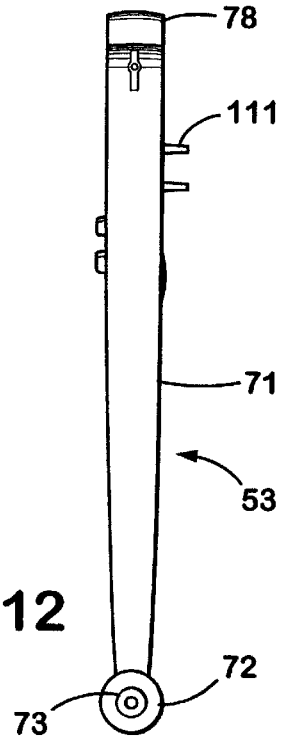
Figure 13:
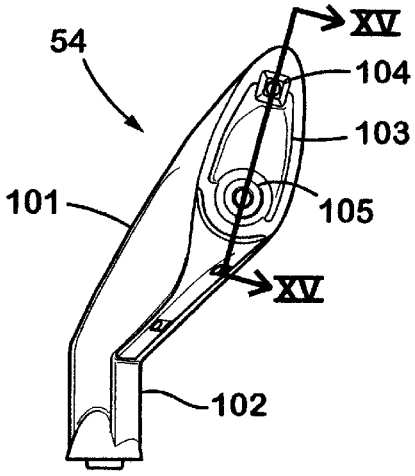
FIGS. 13–14 are front and rear views of the smaller casting making up the legs shown in FIG. 1.
Figure 14:
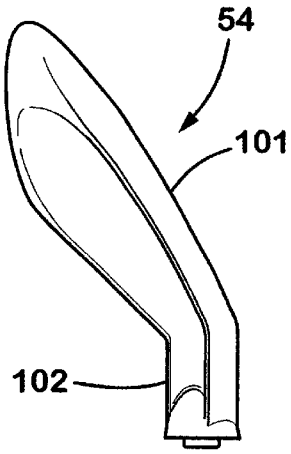
Figure 15:
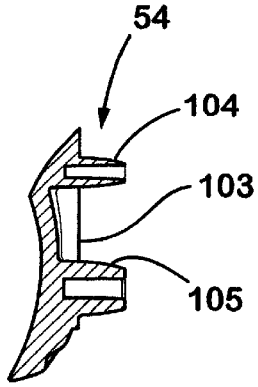
FIG. 15 is a cross-sectional view taken along the line XV—XV in FIG. 13.
Figure 16:
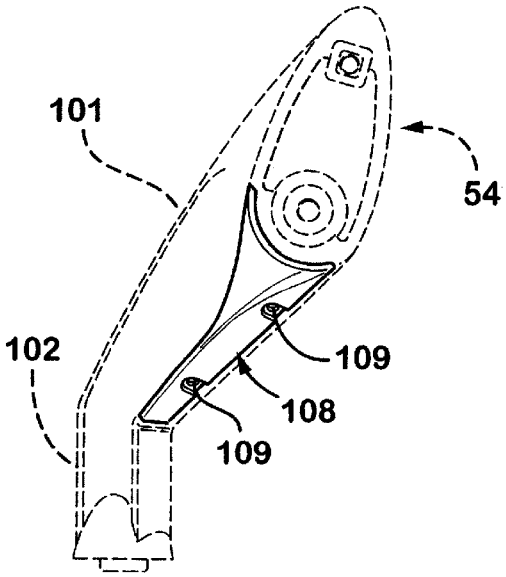
Figure 17:
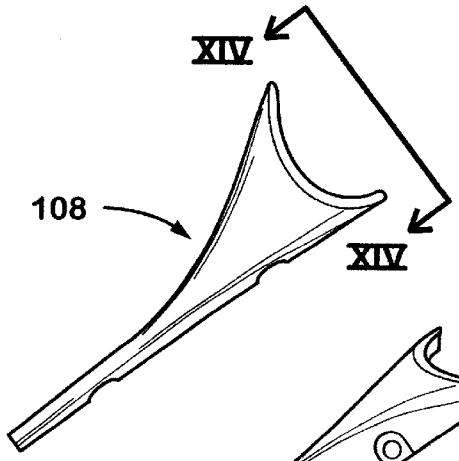
Figure 18:
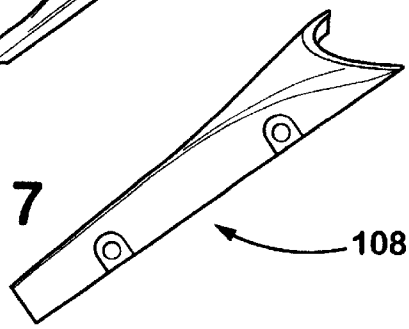
Figure 19:
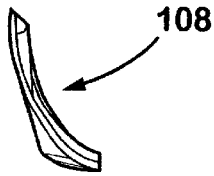
FIG. 19 is an end view of the protector shown in FIG. 17 taken in the direction of lines XIV—XIV.
Figure 20:
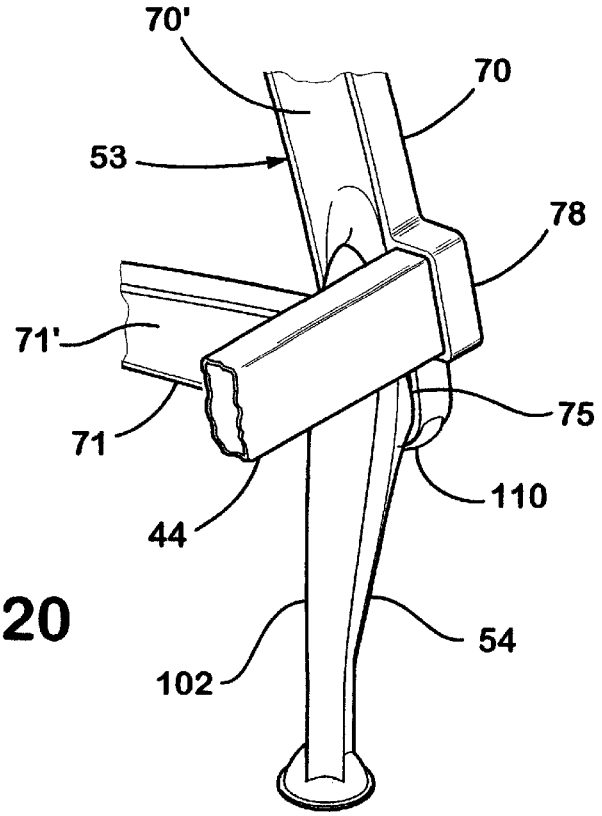
FIG. 20 is an enlarged fragmentary view of the joint connecting the two castings (see FIGS. 10 and 14) forming the legs and of the joint connecting the transverse beam to the legs.

More specifically in regard to the legs, the legs 42 and 43 are substantially mirror images of each other. Accordingly, only leg 42 is described hereafter to reduce redundant discussion except where discussion of leg 43 is also required. A person of ordinary skill will understand the structure of the leg 43 from the discussion of leg 42. Leg 42 is made of two castings bolted together (See FIGS. 20–21), one being a larger casting 53 (FIGS. 10–12) and the other being a smaller casting 54 (See FIGS. 13–15). Leg 43 is also made of two castings, with the smaller casting 54 being a mirror image of the casting 54, but the larger casting 53 being the same as for leg 42, as discussed below. The casting 53 (FIGS. 10–12) is L-shaped and includes an elongated vertically-extending section 70 and an elongated horizontally extending forward section 71. The sections 70 and 71 have an I-beam-like cross-sectional shape, but it is noted that the center flange and the edge webs of the 1-beam-like shape are generously radiused where they join together for aesthetics. Thus, a contoured recess 70' and 71' are formed along sides of the casting 53. The end of the forward section 71 includes an aesthetically contoured bulbous end 72 and a "down" boss 73 for receiving an up stud on a castor 74. Preferably, the castor 74 includes a foot-operated brake that can be easily set to hold the table 40 in a selected position.

A joint is formed at the juncture of sections 70 and 71 (FIG. 10), and includes a raised ridge 75 forming a socket with two attachment depressions 76 and 77 therein. A second attachment section 78 is integrally formed on a bottom portion of the vertically extending section 70 at a location opposite the forwardly extending section 71 and slightly thereabove in a piggyback fashion. This location provides a good and stable support for the transverse beam 44 on the legs 42 and 43. The attachment section 78 includes a rectangular perimeter rib 79 forming a depression shaped to mateably receive an end of rectangular tubular transverse beam 44. A pair of holes 80 are formed in the attachment section 78. A reinforcement plug bracket 81 (FIG. 21) configured to fit into an end of the transverse beam 44 includes a pair of matching threaded holes 82 (or nuts welded in alignment with the holes). The plug bracket 81 is telescoped into an end of the transverse beam 44 and welded, screwed or otherwise secured in place. A pair of bolts 83 are extended through a stiff plate washer 84 through holes 80 and threadably into the holes 82 to secure the plug bracket 81 and beam 44 to the leg 42. Notably, the large casting 53 is relatively flat and lies in a single plane, which simplifies its casting and secondary machining and finishing.

The top section 85 of the larger casting 53 (FIG. 10) includes a horizontally extending flat top surface 85'. A pivot hole 86 for pivotally supporting the tabletop 45 is formed in one end of the top section 85 and a stop 87 is formed on top of the other end. For example, the stop 87 might be a resilient rubber pad. The tabletop 45 is pivoted to the pivot hole 86 at a location slightly offset from a longitudinal centerline of the tabletop, such that the tabletop 45 tends to fall toward its vertical storage position by gravity. When in the horizontal use position, the tabletop 45 engages the stop 87, which stabilizes the tabletop 45 in the use position in a first direction. The tabletop 45 is further held in the horizontal use position by the cantilevered support arms 47 and 48, as discussed below.

Figure 2:
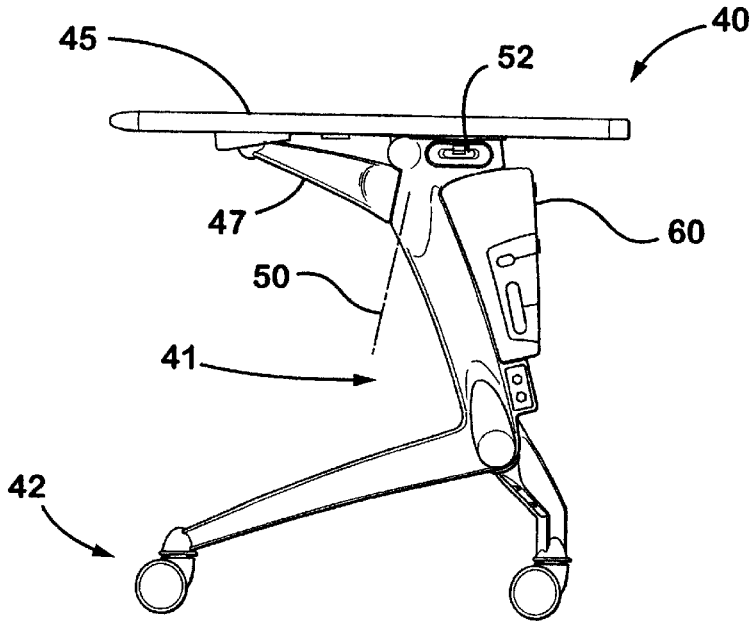
FIGS. 2–7 are orthogonal views of the table of FIG. 1 including a first side, a top, a second side, a front, a bottom and a rear thereof, the dashed lines in FIGS. 4 and 6 showing a pivoted/folded position of the tabletop.
Figure 3:
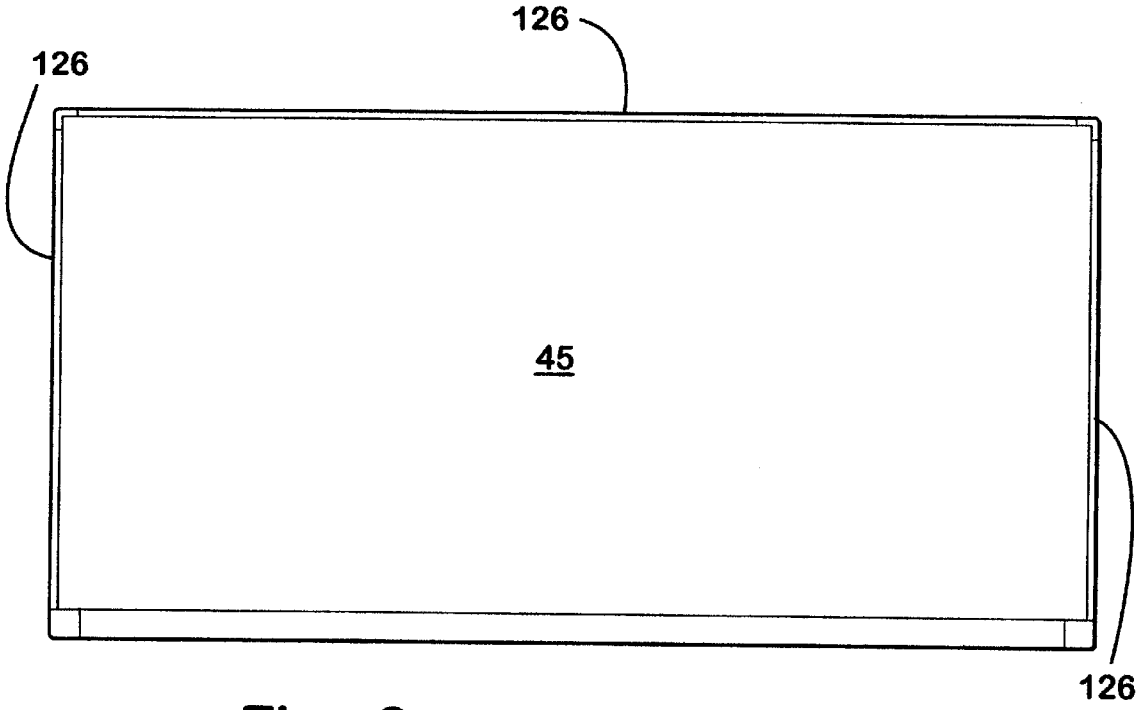
Figure 10:
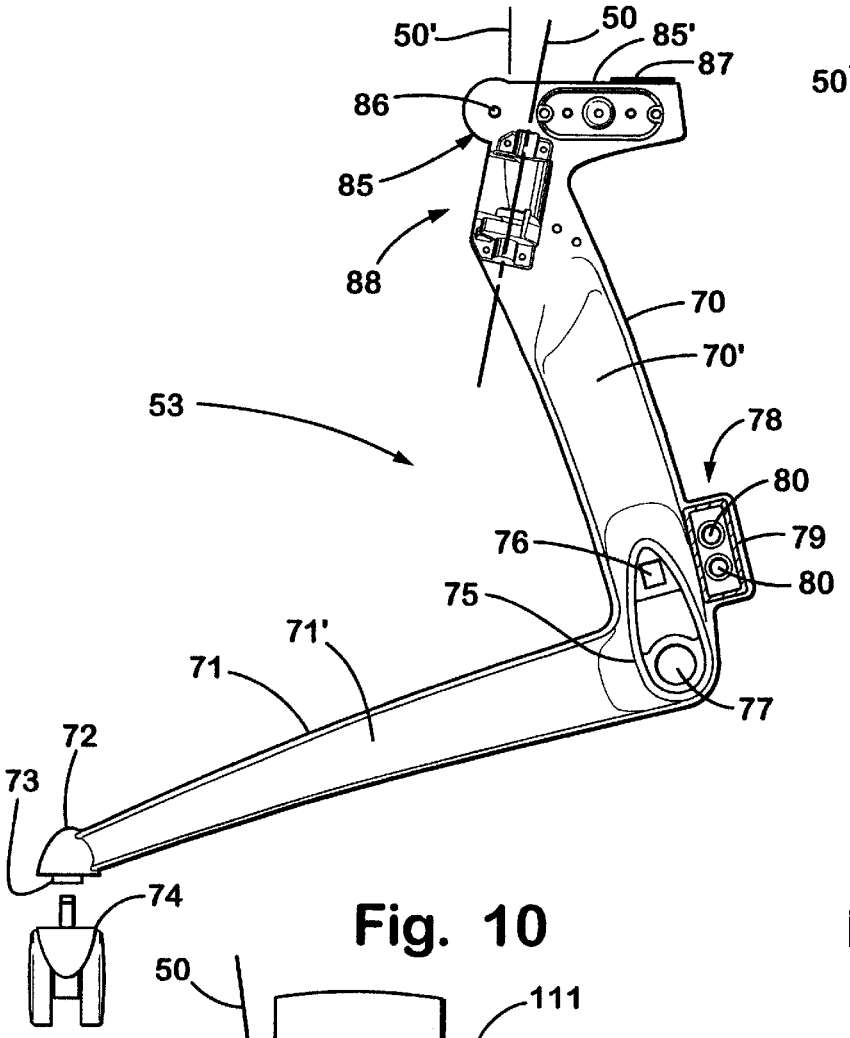
FIGS. 10–12 are side, front and bottom views of the larger of the castings making up the legs shown in FIG. 1.
Figure 11A:
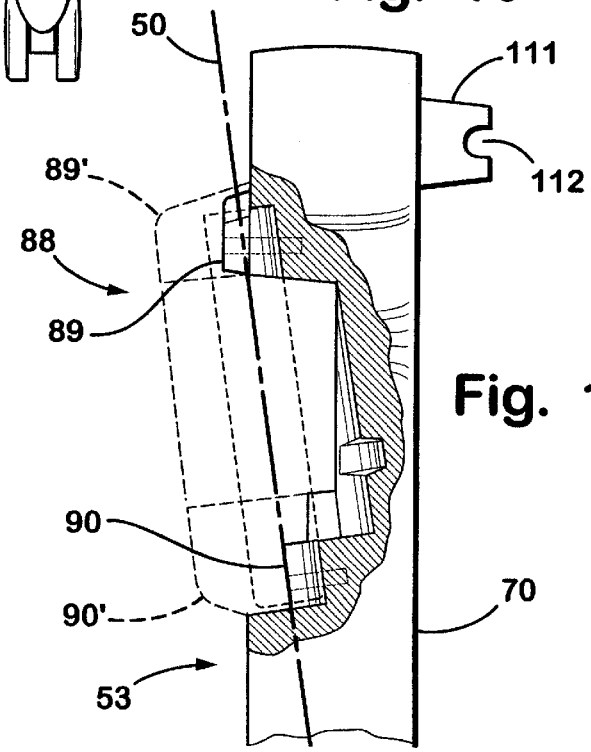
FIG. 11A is an enlarged fragmentary view of a top position of the leg shown in FIG. 11.
Figure 36:
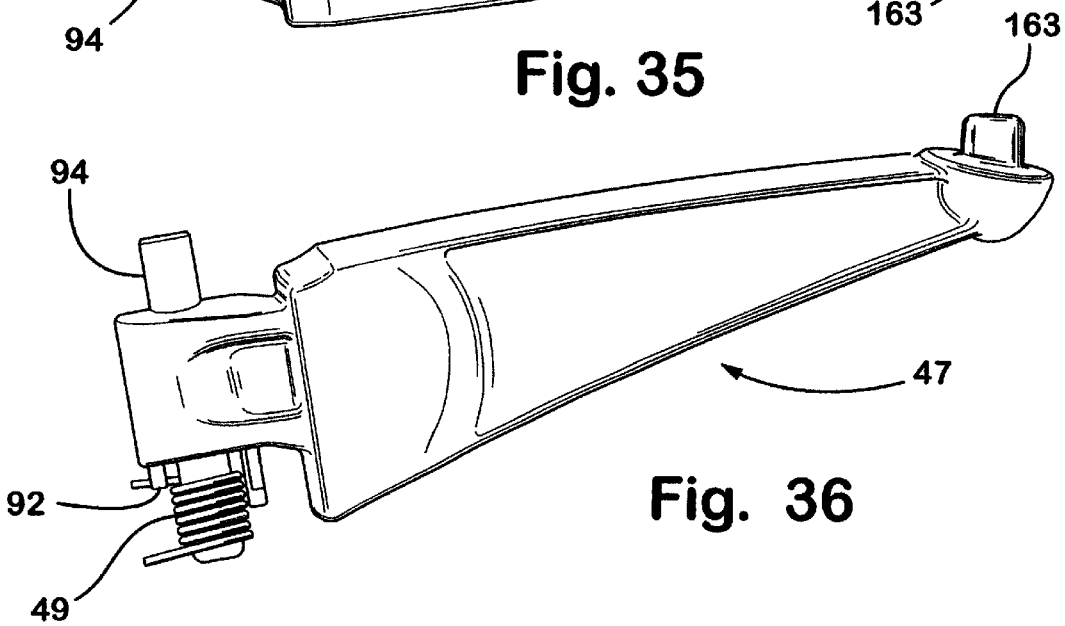
Figure 38A:
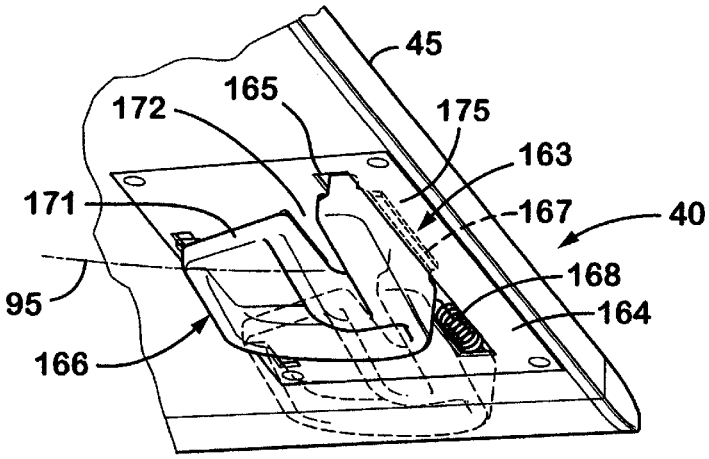
FIG. 38A is a fragmentary bottom perspective view of the arrangement shown in FIG. 37, but not including the support arm.
Figure 38:
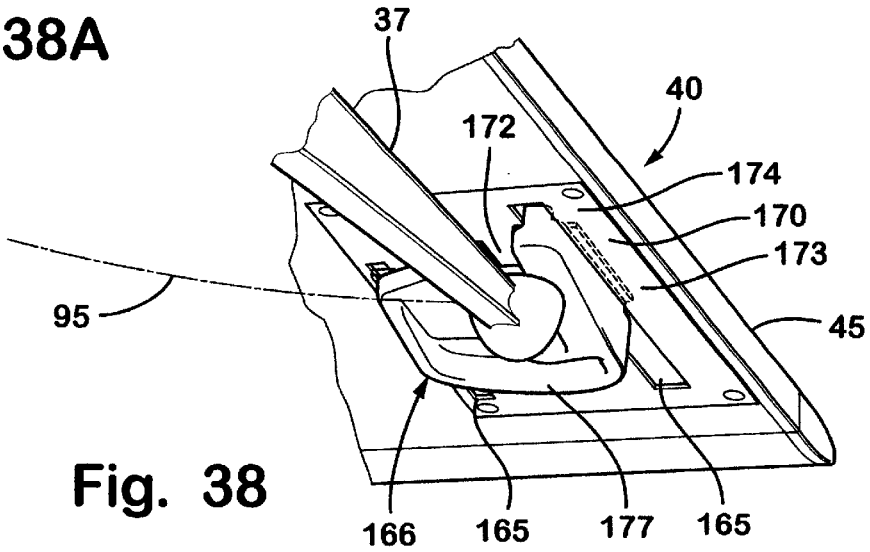
FIG. 38 is a fragmentary bottom perspective view of the arrangement shown in FIG. 37, including the support arm and latch.

Pivot mounts 88 (FIGS. 10 and 11) for support arms 47 (and 48) are formed in the top section of the larger casting 53 on an inboard side. The pivot mounts 88 (FIG. 11A) each comprise a top and bottom flange 89 and 90 that combine with bearing caps 89' and 90' to form holes defining the axis of rotation 50 for the associated support arm 47 (or 48). The support arm 47 (FIG. 36) includes a pivot pin 94 that extends into rotational engagement with the holes in flanges 89 and 90 to define the axis 50. The axis 50 (FIGS. 10 and 11, and also FIGS. 2 and 5) extends at an angle of about 5 to 15 degrees from a plumbed vertical direction 50' (FIG. 11) when viewed from a front, and at an angle of about 5 to 15 degrees from a plumbed vertical direction 50' when viewed from a side (FIG. 10). A coil spring 93 (FIG. 36) wraps around a lower part of the pivot pin 94 of the support arm 47 (and 48). The spring 93 includes a first end that engages a pin stop 92 on the support arm 47, and includes a second end that engages the large casting 53. Preferably, the spring 93 biases the support arm 47 (and 48) outwardly to about 45 degrees, which is significantly short of a fully extended position. A weight of the tabletop 45 will push the support arm 47 (and 48) from this "45 degree" position to the retracted position. Thus, the tabletop will not be held in an unsecure position with the support arms 47 (and 48) partially extended. The arrangement requires that an operator manually move the support arms 47 (and 48) to the fully extended position where they extend 90 degrees as shown in FIGS. 1–2 and 38.

Figure 34:
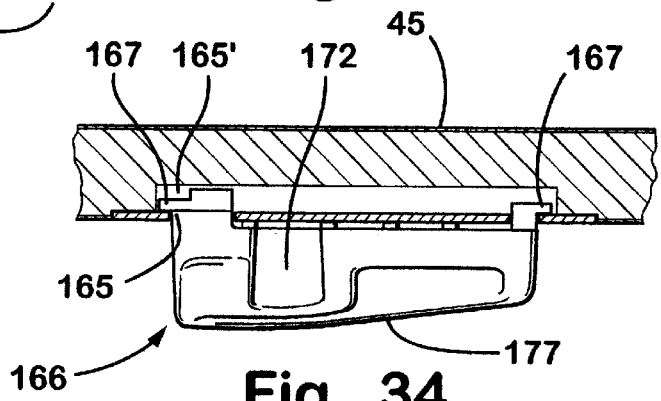
Figure 35:
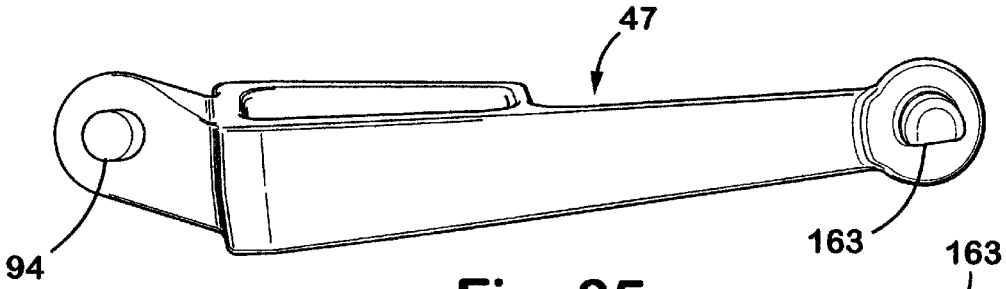
FIGS. 35 and 36 are top and side views of the support arm shown in FIG. 6.

The support arm 47 (and 48)(FIG. 36) is elongated, and includes a perpendicular latching pin 163 that engages the underside of the tabletop 45. A latch 163 for releasably engaging the pin 163 (FIG. 38A) includes a plate 164 screwed to the underside of the tabletop 45. The plate 164 includes slots 165 on each side that form a track, and a groove 165' (FIG. 34) is cut into the tabletop 45 under the slots 165. A latch body 166 includes follower flanges 167 that slide along the slots 165 and hook under the plate 164. A spring 168 (FIG. 38A) biases the latch body 166 toward a semi-secure latched position 170. A front edge of the latch body 166 defines an angled surface 171 and a catch pocket 172. The latch body 166 is movable between a released position 173, the semi-secure latched position 170, and a detent-secure latched position 174. As the latch body 166 is moved to the secure latched position, the latch body 166 wedges under the tabletop 45 to prevent the tabletop 45 from pivoting or "teetering" at the pivot hole 86. It is contemplated that friction will hold the latch body 166. Alternatively, a detent finger 175 on latch body 166 is configured to resiliently engage a depression along the slots 165, and engages the depression when in the detent-locked position 174 for increased security.

When the support arm 47 is moved toward the latch body 166, the latching pin 163 engages the angled surface 171 and drives the latch body toward the released position 173. When the support arm 47 moves to its fully extended position, the latching pin 163 is aligned with the catch pocket 172, such that the spring 168 pushes the latch body 166 to the semi-secure latched position 173. In turn, the latching pin 163 slides along catch pocket 172 to a location near a bottom of the catch pocket 172. A user grasps a handle portion 177 of the latch body 166 to pull the latch body 166 to the more secure, detent-locked position 174. Notably, the combination of the spring-biased movement of the support arms 47 and 48 caused by the angle of the axis 50, the rotation of the tabletop 45 about horizontal axis 46, and the weigh distribution of the tabletop 45 relative to the axis 46, causes the support arms 47 and 48 to counterbalance and support a weight of the tabletop 45 as the tabletop 45 moves from its horizontal use position to its vertical storage position. Specifically, the support arms 47 and 48 move along an arc (see FIG. 6) and slidably engage an undersurface of the tabletop 45 as shown by the phantom lines 95 in FIGS. 6, 38 and 38A. The sliding motion of the support arms 47 and 48 cause the support arms 47 and 48 to move with increased leverage for added stability as the tabletop 45 reaches a horizontal position and as the support arms 47 and 48 near a fully extended position for holding the tabletop 45 in its horizontal use position.

The smaller casting 54 (FIGS. 13–14) includes an elongated angled section 101 and an elongated down section 102 integrally formed on a bottom of the angled section 101. The smaller casting 54 includes an upper end with a horizontally extending protrusion 103 shaped to mateably engage the raised ridge 75 forming the socket on the large casting 53 (FIG. 21), and further includes two protrusions 104 and 105 that matingly engage the two attachment depressions 76 and 77 in the raised ridge 75 (FIG. 10). A mounting plate washer 84' (FIG. 21) abuts a side of the large casting 53 opposite the ridge 75. Bolts 55 and 56 extend through holes in the plate washer 84', through aligned holes in the large casting 53, and threadably into the protrusions 104 and 105 in the smaller casting 54 to secure the castings 53 and 54 together.

An anti-scratch molded protector 108 (FIGS. 16–19 and 21) is attached to the underside of the smaller casting 54 (FIG. 13) with screws 109. A second anti-scratch molded protector 110 (FIG. 21) is attached to a bottom surface of the large casting under the joindure of sections 70 and 71. These two anti-scratch protectors 108 and 110 slidably engage mating portions of the castings 53 and 54 and protect the castings 53 and 54 from being scratched when two tables 40 are nested together. (See FIG. 8.)

As shown in FIGS. 4, 7, and 8, two tables 40 can be nested together by pivoting their respective tabletops 45 to a vertical storage position, and then by moving the tables 45 laterally together. The angled sections 101 of the small castings 54 combine to form a shape like a funnel (see FIG. 7) such that they direct the tables 40 together into an aligned and mating nested engagement. It is noted that the nesting feature allows the tables 40 to be stored in a reduced space that takes up about 50% or less storage area. This density of storage for the table 40 is unusual and is surprisingly and unexpectedly high for a table having the utility support and ganging capability of the present table. Specifically, the tables 40 can be nested together with each table 40 taking up only about an additional 12 inches. This is true, even though the tabletop 45 is about 30 inches to 36 inches wide, and the legs 42 (and 43) span close to that same distance.

A first mount (FIG. 22) is formed on one of the large castings 53 for supporting the male ganging connector 51, and a second mount is formed on the other of the large castings 53 for supporting the latch lever of the female ganging connector 52, as discussed below. The first mount includes a pair of flanges 111 on an outboard side of the top of the large casting 53. The flanges 111 each form a half circle bearing surface 112. Bearing caps 113 are screw-attached to an inboard side of the large casting 53. The bearing caps 113 include a half circle bearing surface that mates with the bearing surfaces 112 on the flanges 111 to form a pivot. The male connector 51 includes a body 114 with a pivot pin 115 extended through the body 114, and a "lollipop" shaped hand 116 with a depression 116' therein. The pivot pin 115 pivotally engages the bearing surfaces 112 so that the pivot pin 115 is rotatably movable about a horizontal axis between a horizontal extended use position and a folded vertical storage position. A spring-biased ball 117 engages depressions 118 in the body 114 to hold the male ganging connector 51 in a selected position. In the storage position, the male ganging connector 51 is adjacent the vertical section 70 of the large casting 53 at a location where users will not accidentally bump into it.

The female ganging connector 52 (FIGS. 23, 28–29, 31) includes a bell-shaped or "chute" -defining ring member 120 that defines a funnel inlet 120'. The ring member 120 attaches to an outboard side of the top of the large casting 53. Notably, the flanges 111 are on an inboard side of the large casting 53 when the large casting 53 is used on the other leg 43. The present table construction allows the same large casting 53 to be used on both legs 52 and 53. The latching lever 121 (FIG. 23) includes a body having a pivot pin 122 transversely through its mid section, a hooked end 123 and a finger trigger portion 124 at its other end. With the pivot pin 122 engaged in the bearing surfaces 112 of the flanges 111, the hooked end 123 extends to a central location in the funnel inlet 120' of the ring member 120. A spring 125 engages an inboard side of the large casting 53 and engages a stud 126 on the lever 121, such that the lever 121 is biased to a latched position. The finger trigger portion 124 includes a curved top surface that is C-shaped, and that it looks like a trigger such that it has a comfortable feel to a person operating the latching lever 121. The trigger portion 124 is visible when the tabletop 45 is in its vertical storage position, and further is located near the ganging connectors 51 and 52, such that it is easy to find and intuitive to operate, and so that it is readily accessible at all times.

Figure 31:
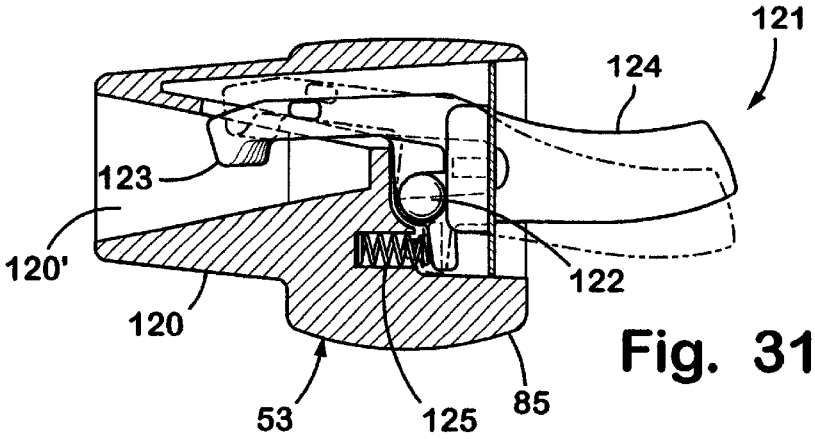
FIG. 31 is an enlarged view of the female ganging connector shown in FIG. 23, the mounting portion being shown in cross section to reveal the latching lever and its mounting.
Figure 30:
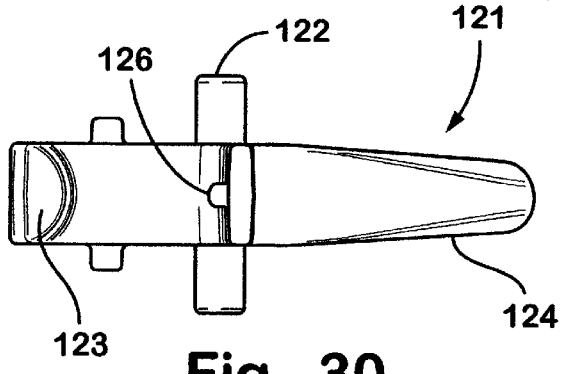
FIG. 30 is a bottom view of the latching lever shown in FIG. 23.
Figure 29:
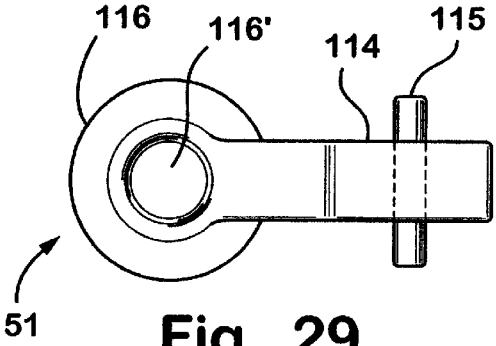
FIGS. 28 and 29 are side and top views of the male connector shown in FIG. 22, FIG. 26 being partially shown in cross section at the male end of the ganging connector.
Figure 28:
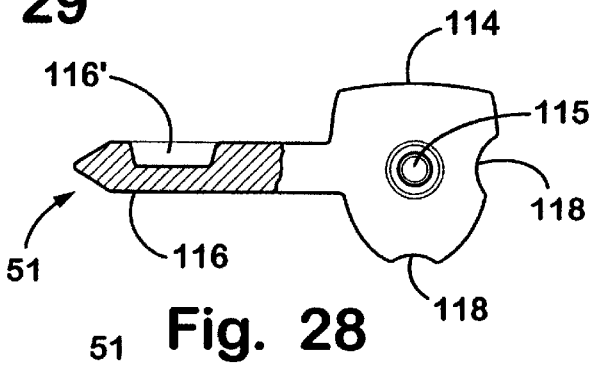
Figure 26:
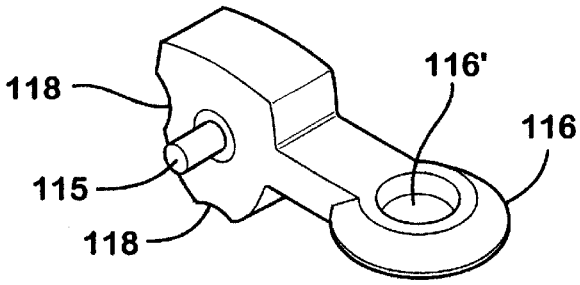
FIGS. 26 and 27 are front/top and bottom/rear perspective views of the male connector shown in FIG. 22.
Figure 27:
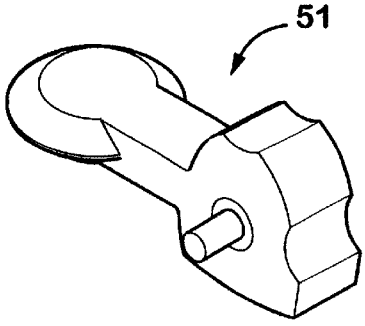
Figure 32:
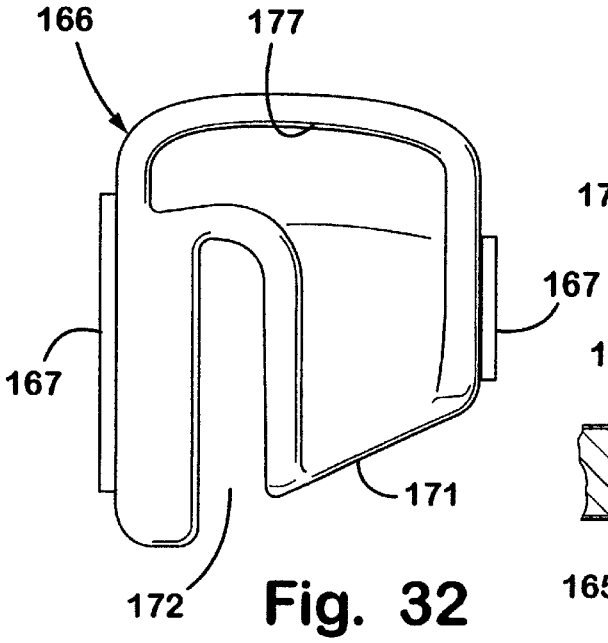
FIGS. 32–34 are plan, side and end views of the sliding arm latch shown in FIG. 6, the end view showing the tabletop.
Figure 33:
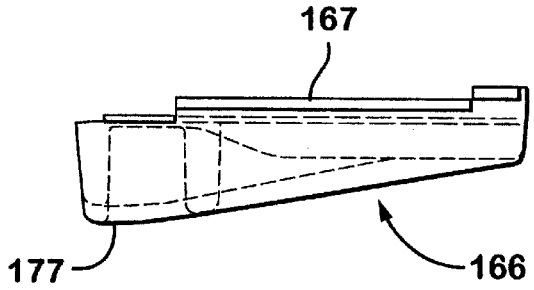

As shown in FIG. 31, the latch lever 121 is movable between a normal at-rest position (where it engages a male ganging connector 51) and a raised released position (shown in phantom lines) where a male ganging connector 51, if present, is released. Notably, the male ganging connector 51 includes a tapered and rounded outer nose on its hand 116. The nose is wedgeshaped and has a rounded nose surface configured to engage the hooked end 123 and automatically move the latching lever 121 to its released position when two tables 40 are moved together. Once fully together, the hooked end 123 snaps into secure engagement by action of the spring 125 to hold the two tables 40 together in a ganged arrangement. The hooked end 123 mateably engages and hooks into the depression 116' in the hand 116 such that the ganged connection closely and accurately defines the close spacing of the two tabletops 45 of the two ganged tables 40. The funnel inlet 120' of the female ganging connector 52 and the rounded nose of the male ganging connector 51 both include angled side surfaces that abut to cause the two tables 40 to automatically align as the tables 40 are pushed together.

Figure 39:
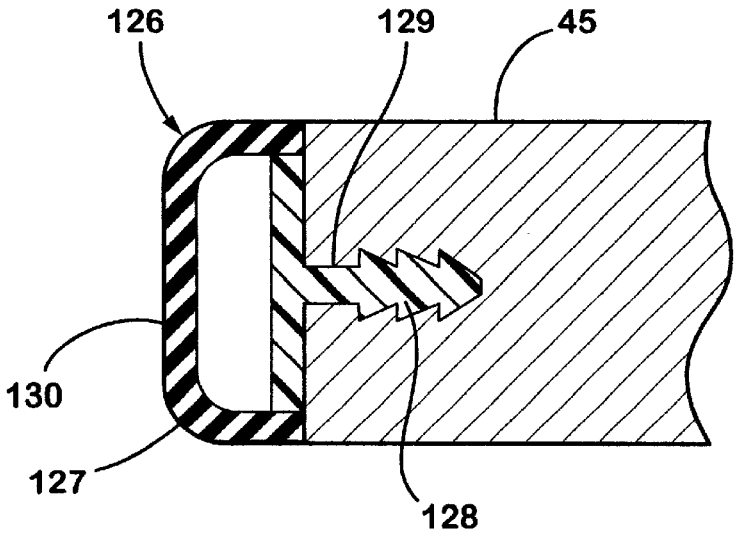
FIG. 39 is a fragmentary cross-sectional view of the tabletop edging shown in FIG. 3.

It is important when two tables 40 are ganged together that the tabletops 45 be tight together so that they can be moved as a unit or "train". It is also preferable that there not be any light leak between the tabletops 45. A tight fit helps assure an attractive ganged connection, and further helps prevent items from falling between tabletops 45 of two ganged tables 40. Nonetheless, normal manufacturing variations can make it difficult to hold tight tolerances. A resilient edging 126 (FIG. 39) solves this problem by including a bulbous hollow portion 127 made of rubber, elastomer, or the like, and a "carrot" or barbed retention leg 128 made of stiffer or higher durometer material. The tabletop 45 includes an outer edge with a groove 129 cut therein. The retention leg 128 friction fits into the groove 129 to retain the edging 126 to the tabletop 45. If necessary, corner pieces can be added of high durometer material to further assure that two tables, when ganged together, maintain alignment even when a user grasps an end of one table 45 as a way of manipulating a ganged arrangement of two or three tables 45. Also, one or both of the front and rear edges of the tables 45 can be made of higher durometer material, if desired. The ganging connectors 51 and 52 engage such that the hollow portions 127 on each ganged tabletop 45 engage, causing the hollow portions 127 to compress slightly. Thus, the ganged connection of tables 40 does not have any light leak between tabletops 45. The hollow portion 127 includes a flat top section that extends flush with a top surface of the tabletops 45, and further includes a vertical side surface 130. The vertical side surface 130 of ganged tables is slidable relative to the vertical side surface 130 of a mating ganged tabletop 45. This permits the tabletops 45 of ganged interconnected tables 40 to be individually pivoted between use and storage positions, even while the tables 40 are interconnected. (See FIG. 40.) For example, this can facilitate connecting utilities of an electronic device on a given table to utilities in the adjacent table. Also, it facilitates working on ganged tables generally.

Figure 44:
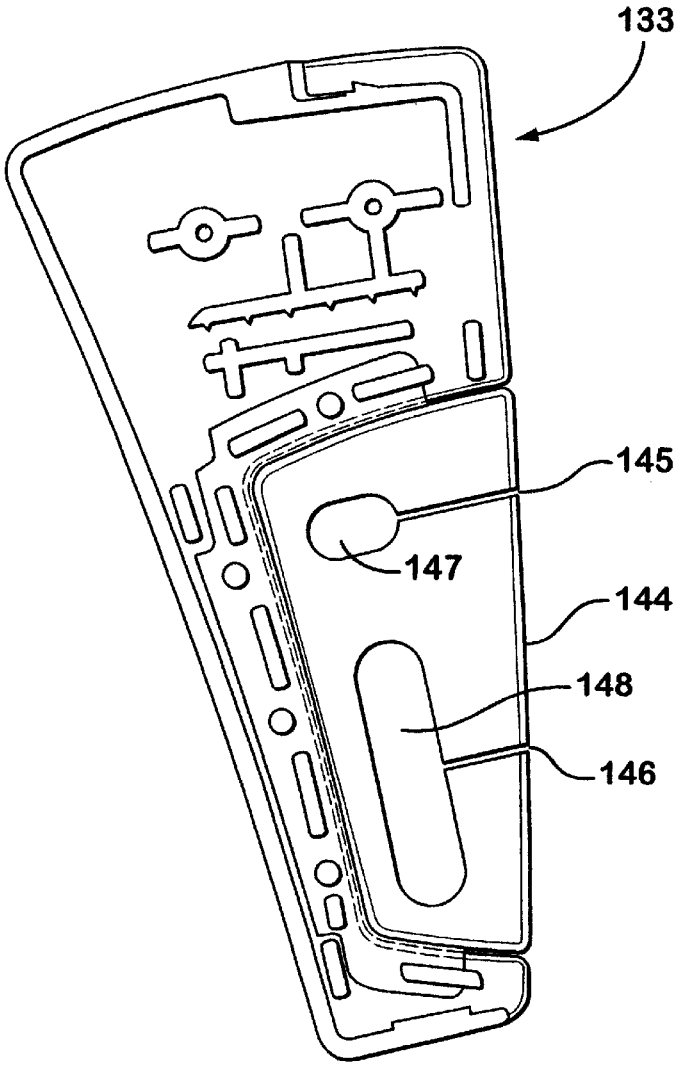
FIG. 44 is a plan view of the end piece shown in FIGS. 41 and 42.
Figure 45:
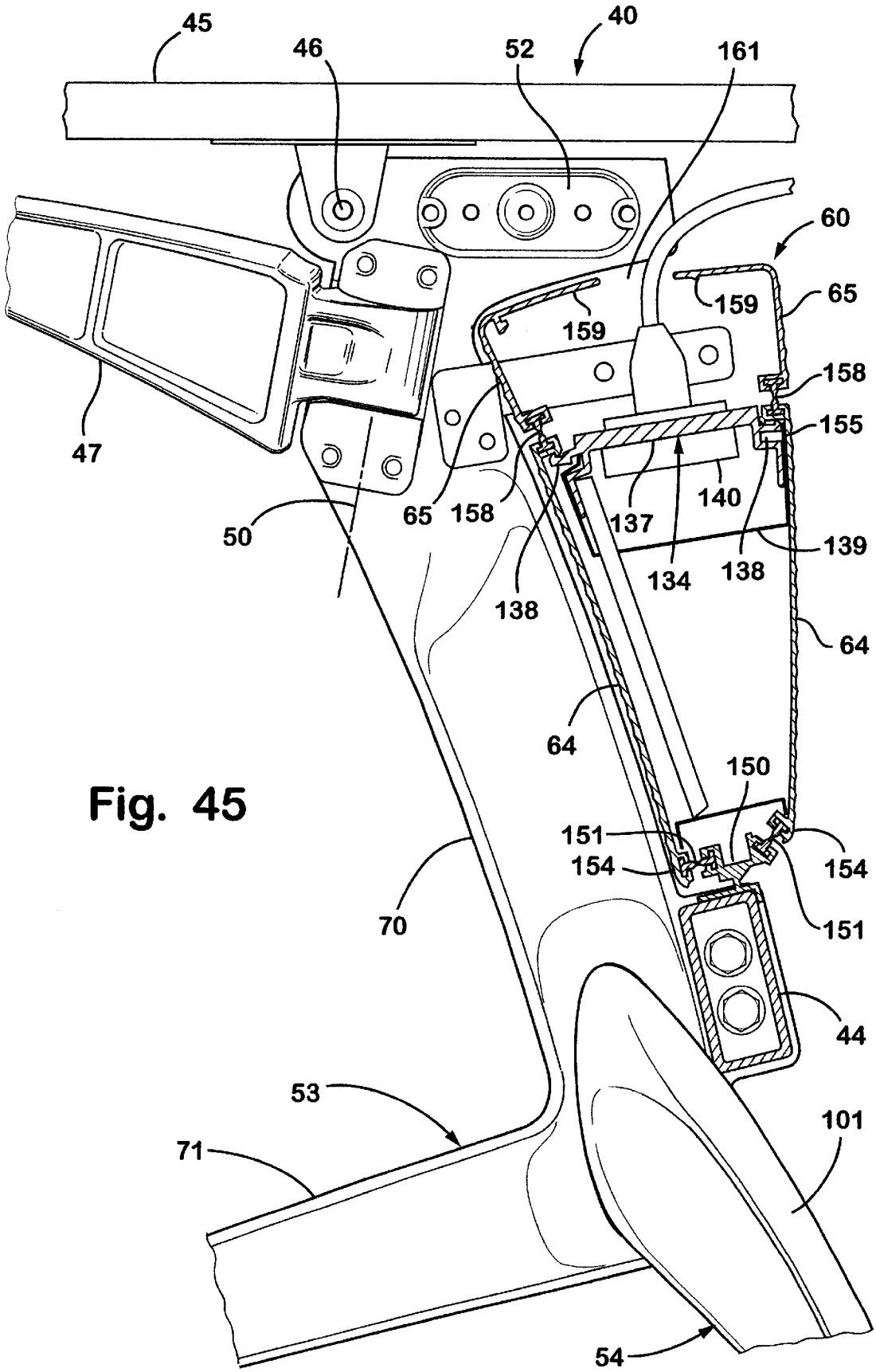
FIG. 45 is a cross-sectional view taken vertically and transversely across a center of the tabletop.

The frame 61 of utility module 60 (FIGS. 41–42) is shaped like a ladder, and includes a top extruded horizontal frame member 134, a bottom horizontal frame member 135, and several vertical frame members 136. End frame members 133 are attached to each end of the frame 61. The top frame member 134 (FIG. 45) includes a center web 137, and front and rear lips 138. Openings are formed in the center web 137 (FIG. 41) and U-shaped attachment brackets 139 are attached under the openings. It is contemplated that the openings can be cut in the center web 137, or scored therein, such that they can be punched out in the field. The openings are sized and shaped to permit utility outlets, such as duplexes 140, simplexes, and communication outlets 141, to be snapped into the openings, with faces of the utility outlets being accessible from above the top frame member 134 (see FIG. 45). Utility source cabling 69 is routed into the U-shaped attachment brackets 139 and is connected to utility source connectors, such as wire terminals, on a bottom of the utility outlets. Holders 143 on the vertical frame members 136 engage and hold the utility source cabling 142. A resilient panel 144 (FIG. 44) attached to end frame members 133 have slits 145 and 146 and openings 147 and 148 that allow the utility source cabling 69 to be routed through the frame end members 133 and out of the utility module 60 for connection to a utility source (not specifically shown). Notably, the utility source cabling 69 can be permanently attached to the table 45, and it is contemplated that they can have a length chosen to electrically connect to an electrical connector of an adjacent ganged table 45. Specifically, with two tables 45 ganged together, the cabling 69 would be slipped through slot 145 (or 146, see FIG. 44) and into apertures 147 (or 148). The cabling 69 would then be connected to a left side of one of the electrical components 139, 140 or 141 in the ganged table, to create a series electrical connection. It is contemplated that cabling 69 can also be extended into the utility module 60 from a front or rear of the table, or vertically up into the utility module 60 by incorporating openings in the front, rear or bottom of the utility module 60.

A hinge bracket 150 (FIG. 45) is attached to the bottom horizontal frame member 135 and provides two flexible continuous hinge members 151. Lower doors 64 each include a bottom edge 154 attached to the associated hinge member 151, and include an upper edge lip 155 configured to releasably frictionally engage the lip 138. A key lock 156 (FIG. 42) (or non-keyed twist lock) with a locking finger adapted to engage a flange on the frame 61 can be attached to the lower door 152 if added security is desired to prevent unauthorized access to the cavity defined between the horizontal frame members 134 and 135 where the utility source cabling 142 is located. The front and rear lower doors 64 are similar in construction and operation. A catch or hook-and-loop material can be used to hold the door 64 closed.

A second hinge 158 (FIG. 45) is attached to a top edge of each lower door 64, and an upper door 65 is pivoted to the second hinge 158. Each upper door 65 includes an upper flange 159 that extends inwardly and that frictionally engages either a top part of the large casting 53 or an inboard surface of the end frame members 133. A key lock 160 (FIG. 42) can be provided on the upper door 64 if added security or added holding strength is needed. However, it is noted that, when the tabletop 45 is pivoted to its vertical storage position, a gap 161 (FIG. 45) is provided between the upper flanges 159. such that the utility outlets are accessible and exposed for easy access. The frame 61 is attached to the base 41 (FIG. 41) by brackets 162 and end frame members 133, each of which are screw-attached or otherwise secured together. A detent or hook-and-loop material can be used to hold the door closed.

It will be readily apparent to those skilled in the art that modifications and changes can be made from the disclosed preferred embodiment without departing from a scope of the present invention. Such modifications and variations are to be considered as included in the present invention, unless the claims by their language expressly require otherwise.

The invention claimed is:

1. A table construction comprising:

a base;

a tabletop pivoted to the base for movement about a first axis between a horizontal use position and an angled storage position; and at least one support arm pivoted to the base for movement about a second axis between a tabletop-braced position where the tabletop is held in the horizontal use position and a released position where the tabletop is released for movement to the storage position, the at least one arm being biased and pivoted to slidably engage the tabletop and counterbalance a weight of the tabletop as the tabletop is pivoted between the use and storage positions.

2. The table construction defined in claim 1, wherein the first axis bisects the tabletop in an offset location so that the weight of the tabletop biases the tabletop toward the storage position.

3. The table construction defined in claim 2, wherein the second axis is at an acute angle to a plumbed vertical direction.

4. The table construction defined in claim 3, wherein the at least one support arm includes two support arms.

5. The table construction defined in claim 4, wherein the support arms are each pivoted at a location below but proximate the first axis.

6. The table construction defined in claim 5, wherein the support arms are located generally below the first axis when in the released position, but extend laterally away from the location below the first axis when in the tabletop-braced position.

7. The table construction defined in claim 1, including a utility module having a utility outlet supported on the base, and wherein the tabletop when pivoted to the storage position uncovers the utility module.

8. The table construction defined in claim 1, wherein the at least one support arm includes an end section that slidably engages a bottom surface of the tabletop.

9. The table construction defined in claim 8, including a latch attached to the tabletop, the latch being configured to releasably engage the end section.

10. The table construction defined in claim 9, wherein the latch is positionable in a first position for receiving the end section, a second position for engaging and holding the end section in a releasable but semi-secure manner, and a third position where the latch is locked and held in a secure manner that will not release when the latch is bumped.

11. The table construction defined in claim 1, including ganging connectors located at opposite ends of the tabletop, the ganging connectors being configured to releasably engage mating ganging connectors on adjacent tables.

12. The table construction defined in claim 1, including a utility module attached to the base and located below the tabletop when the tabletop is in the horizontal use position, but located generally adjacent the tabletop when the tabletop is in the storage position.

13. A table construction comprising:

a base;

a tabletop pivoted to the base for movement about a first axis between a horizontal use position and an angled storage position; and the base including a pair of legs connected by a transverse beam, the pair of legs each including first and second leg members having joint sections that matingly engage and are secured together, the first leg member having a forward extension and the second leg member having a rearward extension, said forward extension being inboard of the rearward extension so that, when the tabletop is in the storage position, the forward extension is adapted to extend inboard of and adjacent a rearward extension of a similar table construction when nested thereagainst, wherein at least one of the first leg members comprises a casting with a pocket for mateably receiving and engaging the transverse beam.

14. The table construction defined in claim 13, wherein the first and second leg members each comprise a casting.

15. The table construction defined in claim 13, wherein a top of each leg includes a pivot mount pivotally engaging the tabletop.

16. The table construction defined in claim 15, wherein the top of each leg includes a stop for abutting the tabletop to stabilize the tabletop in the horizontal use position.

17. The table construction defined in claim 16, wherein the top of each leg includes a mount for mounting a ganging connector.

18. A table construction comprising:

a base;

a tabletop pivoted to the base for movement about a first axis between a horizontal use position and an angled storage position; and the base including a pair of legs connected by a transverse beam, the pair of legs each including first and second leg members having joint sections that matingly engage and are secured together, the first leg member having a forward extension and the second leg member having a rearward extension, said forward extension being inboard of the rearward extension so that, when the tabletop is in the storage position, the forward extension is adapted to extend inboard of and adjacent a rearward extension of a similar table construction when nested thereagainst, wherein at least one of the second leg members includes a pocket and first holes that align with a protrusion and second holes in an associated one of the first leg members, and including fasteners extending through the first and second holes and securing the associated first and second leg members together.

19. A table construction comprising:

first and second tables each having a base and a tabletop supported on the associated base, the first table including a male connector at a first end and the second table including a female connector at a second end configured to releasably engage the male connector, the female connector defining a funnel-shaped chute with angled sidewalls shaped to receive the male connector and shaped to automatically align the first and second tables in a predetermined ganged arrangement when the first and second tables are moved together; and a latch on the female connector configured to automatically grab and retain the male connector upon the male connector engaging the female connector.

20. The table construction defined in claim 19, wherein the male connector includes a depression, and the latch includes a protrusion that releasably engages the depression in the male connector.

21. The table construction defined in claim 19, wherein the tabletop of the first and second tables have abutting edges that are adjacent when the first and second tables are interconnected, at least one of the adjacent abutting edges having a resilient edging that compresses when the male and female connectors are engaged to place tension on the male and female connectors.

22. A table construction comprising:

first and second tables each having a base and a tabletop supported on the associated base, the first table including a male connector at a first end and the second table including a female connector at a second end configured to releasably engage the male connector, the female connector defining a funnel-shaped chute with angled sidewalls shaped to receive the male connector and shaped to automatically align the first and second tables in a predetermined ganged arrangement when the first and second tables are moved together, a latch having a protrusion shaped to engage the male connector and further including a finger-operated trigger release operably attached to the protrusion and positioned at a top of the base in an easily accessed location for releasing the male connector from the female connector.

23. A table construction comprising:

first and second tables each having a base and a tabletop supported on the associated base, the first table including a male connector at a first end and the second table including a female connector at a second end configured to releasably engage the male connector, the female connector defining a funnel-shaped chute with angled sidewalls shaped to receive the male connector and shaped to automatically align the first and second tables in a predetermined ganged arrangement when the first and second tables are moved together; and wherein the chute has rectangular vertical cross section having a width at least about twice a width of the male connector.

24. A table construction comprising:

first and second tables each having a base with legs and a tabletop supported on the associated base, the first table including a male connector at a first end and the second table including a female connector at a second end configured to releasably engage the male connector, the male connector defining a nose surface shaped to matably engage the female connector and automatically align the first and second tables in a predetermined ganged arrangement as the first and second tables are moved together, the male connector being pivotally movable about a horizontal axis between a horizontal engagement position where the male connector extends from an associated one of the legs and a lowered storage position where the male connector is positioned adjacent the associated one leg.

25. The table construction defined in claim 24, wherein the nose surface includes a latching aperture, and wherein the female connector includes a latch for engaging the aperture.

26. The table construction defined in claim 24, wherein the base of the first table includes a selected one of the plurality of legs, and wherein the male connector is pivoted to the one leg.

27. The table construction defined in claim 24, including a latching lever pivotally connected to the female connector.

28. The table construction defined in claim 27, including a latch on one of the male and female connectors that includes a finger-operated trigger release.

29. The table construction defined in claim 24, wherein the female connectors each include a chute that defines a rectangular opening and that has a cone-shaped vertical cross section.

30. The table construction defined in claim 24, wherein an edge of the first tabletop has a resilient edging that compresses when the first and second tables are connected together and that creates tension on the male and female connectors.

31. A table construction comprising:

a base;

a tabletop supported to the base;

the base including a pair of legs connected by a transverse beam; and a utility module attached to the base, the utility module defining upper and lower chambers and including upper and lower doors providing separate access to the upper and lower chambers, respectively; and wherein the tabletop is pivoted to the base for movement about a first axis between a horizontal use position and an angled storage position, the tabletop uncovering the utility module when in the angled storage position.

32. The table construction defined in claim 31, wherein the upper and lower doors both extend a width of the base.

33. The table construction defined in claim 31, including third and fourth doors on a side of the utility module opposite the upper and lower doors.

34. A table construction comprising:

a base;

a tabletop supported to the base;

the base including a pair of legs connected by a transverse beam; and a utility module attached to the base, the utility module defining upper and lower chambers and including upper and lower doors providing separate access to the upper and lower chambers, respectively; and wherein the utility module is fastened to the base and rests on the transverse beam.

35. A table construction comprising:

a base;

a tabletop attached to the base; and a utility module attached to the base, the utility module including a frame with upper and lower transverse beams defining a chamber therebetween;

a utility outlet attached to the upper beam, the utility outlet including a face accessible from above the upper transverse beam that is adapted for releasable connection to a utility-using device and including a utility supply connector accessible from below the upper transverse beam; and a utility supply conduit positioned in the chamber and operably connected to the utility supply connector.

36. The table construction defined in claim 35, including a door attached to one of the upper and lower beams covering the chamber.

37. The table construction defined in claim 36, including an upper door attached to the utility module that is separate from the first-mentioned door.

38. The table construction defined in claim 36, including a second door attached to one of the upper and lower beams covering the chamber on a side opposite from the first-mentioned door.

* * * * *

UNITED STATES PATENT AND TRADEMARK OFFICE

CERTIFICATE OF CORRECTION

PATENT NO. : 6,336,414 B1
DATED : January 8, 2002
INVENTOR(S) : Robert L. Stewart et al.

It is certified that error appears in the above-identified patent and that said Letters Patent is hereby corrected as shown below:

Title page,
After Inventors, insert -- [73] Assignee: Steelcase Development Corporation, Caledonia, Michigan --;

Signed and Sealed this

Twenty-second Day of October, 2002

*Attest:*

*Attesting Officer*

JAMES E. ROGAN
*Director of the United States Patent and Trademark Office*